US011234471B1

(12) United States Patent
Jhin et al.

(10) Patent No.: US 11,234,471 B1
(45) **Date of Patent: *Feb. 1, 2022**

(54) PACKAGED SYNTHETIC BRAIDING HAIR

(71) Applicant: JBS Hair Inc., Doraville, GA (US)

(72) Inventors: Eddie K Jhin, Atlanta, GA (US); Jae Hoon Lee, Duluth, GA (US)

(73) Assignee: JBS Hair, Inc., Doraville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/199,873

(22) Filed: Mar. 12, 2021

Related U.S. Application Data

(63) Continuation-in-part of application No. 16/992,935, filed on Aug. 13, 2020, now Pat. No. 10,945,478, which is a continuation-in-part of application No. 15/380,324, filed on Dec. 15, 2016, now Pat. No. 10,786,026.

(51) Int. Cl.
*A41G 5/00* (2006.01)
*B65D 73/00* (2006.01)

(52) U.S. Cl.
CPC ..... *A41G 5/004* (2013.01); *B65D 73/0007* (2013.01)

(58) Field of Classification Search
CPC ..... A41G 5/006; A41G 5/0046; A41G 5/004; B65D 73/0021; B65B 5/04
USPC ..... 132/201, 53, 54, 55, 56
See application file for complete search history.

(56) References Cited

U.S. PATENT DOCUMENTS 578,623 A 3/1897 Borden
1,257,393 A 2/1918 Reifsnyder
3,557,806 A 1/1971 Blanchard
5,497,795 A 3/1996 Hibbard
5,722,434 A 3/1998 Walker
5,775,343 A 7/1998 Zam
6,035,861 A 3/2000 Copello
6,135,122 A 10/2000 Campbell et al.
6,159,598 A 12/2000 Ishimura
D440,715 S 4/2001 Sartena
(Continued)

FOREIGN PATENT DOCUMENTS

OA 9811 4/1994

OTHER PUBLICATIONS

Double Weft 100% Remy Human Hair Clip in Extensions 14"-22" Grade 7A Quality Full Head Thick Long Soft Silky Straight 8pcs 18 clips for Women Fashion (22".22 inch 160g, 2 dark brown); by MY_LADY; Reviewed on Amazon.com Jul. 24, 2016.
(Continued)

*Primary Examiner* — Nicholas D Lucchesi
(74) *Attorney, Agent, or Firm* — Philip H. Burrus, IV

(57) ABSTRACT

A hair accessory includes bundled synthetic braiding hair. The bundled synthetic braiding hair can include a first bundle of synthetic hair and a second bundle of synthetic hair strands. Other bundles with different lengths can be included as well. The first bundle and the second bundle can have different lengths and can be bundled at a common center, or alternatively can have a common length and can be bundled with their centers offset by a predefined distance. A binder can be coupled about a waist of the bundled synthetic braiding hair. When the bundled synthetic braiding hair is folded about the binder, the different strand lengths work to define a substantially cardioid shaped perimeter of the bundled synthetic braiding hair.

20 Claims, 14 Drawing Sheets

(56) References Cited

U.S. PATENT DOCUMENTS

| | | | | |
|---|---|---|---|---|
| D488,587 | S | 4/2004 | Puorro | |
| 7,047,571 | B1 | 5/2006 | Kelly | |
| D561,938 | S | 2/2008 | Madden | |
| D642,744 | S | 8/2011 | Hunt-Larder | |
| D668,818 | S | 10/2012 | Jones | |
| D675,402 | S | 2/2013 | King | |
| 8,439,237 | B2 | 5/2013 | Choi | |
| D685,135 | S | 6/2013 | Jazwinski et al. | |
| 8,590,543 | B2 | 11/2013 | Goff et al. | |
| D703,385 | S | 4/2014 | Adams | |
| D704,893 | S | 5/2014 | Dierker | |
| 8,800,827 | B2 | 8/2014 | Choi | |
| 9,220,329 | B1 | 12/2015 | Kim | |
| D766,550 | S | 9/2016 | Coggins et al. | |
| 10,080,396 | B2 | 9/2018 | Adjesson | |
| D829,997 | S | 10/2018 | Johnson | |
| 10,160,584 | B2 | 12/2018 | Yi | |
| 10,231,501 | B2 * | 3/2019 | Crocilla | A41G 5/0066 |
| 10,993,493 | B2 * | 5/2021 | Kim | A41G 5/0046 |
| 2004/0168699 | A1 | 9/2004 | Park | |
| 2005/0268929 | A1 | 12/2005 | Frazier | |
| 2006/0191550 | A1 | 8/2006 | Frazier | |
| 2008/0163882 | A1 | 7/2008 | Owens et al. | |
| 2009/0014023 | A1 | 1/2009 | Waters | |
| 2009/0260649 | A1 | 10/2009 | Sakurai et al. | |
| 2009/0272396 | A1 | 11/2009 | Tochioka | |
| 2009/0289088 | A1 | 11/2009 | Choi | |
| 2010/0037907 | A1 * | 2/2010 | Sugai | D05C 15/02 132/201 |
| 2010/0154815 | A1 | 6/2010 | Chang | |
| 2011/0132942 | A1 | 6/2011 | Choi | |
| 2011/0271976 | A1 | 11/2011 | Sasayama | |
| 2012/0145174 | A1 | 6/2012 | Frazier | |
| 2012/0298127 | A1 | 11/2012 | Yi | |
| 2013/0098380 | A1 | 4/2013 | Kim | |
| 2014/0191634 | A1 | 7/2014 | Smiley | |
| 2015/0189936 | A1 | 7/2015 | Murphy | |
| 2015/0223537 | A1 | 8/2015 | Kim | |
| 2016/0128408 | A1 | 5/2016 | Phillips | |
| 2016/0206030 | A1 | 7/2016 | Yi | |
| 2016/0213083 | A1 | 7/2016 | Kim et al. | |
| 2016/0219958 | A1 | 8/2016 | Wang et al. | |
| 2017/0127742 | A1 | 5/2017 | Riggins | |
| 2017/0202291 | A1 | 7/2017 | Kim et al. | |
| 2017/0224036 | A1 | 8/2017 | Kim et al. | |
| 2017/0251739 | A1 | 9/2017 | Kim et al. | |
| 2018/0199687 | A1 | 7/2018 | Ham et al. | |
| 2018/0228236 | A1 | 8/2018 | Curbeon | |
| 2019/0075870 | A1 | 3/2019 | Han | |
| 2019/0191803 | A1 | 6/2019 | Han | |

OTHER PUBLICATIONS https://www.amazon.com/Brazilian-Natural-Straight-Extension-Unprocessed/dp/BOOF7QQHJA/ref-sr_1_3_a_it?ie-UTF8&qid=1546833123&sr=8-3&keywords=le+hair+virgin+brazilian+natural+straight+hair+weave; Reviewed on Amazon.com Aug. 30, 2015.

https://www.amazon.com/Extension-Extensions-Double-7pieces-105gram/dp/B01LZVVPDZ/ref-sr_1_2_a_it?ie=UTF8&quid-1546832408&sr-8-2-spons&keywods=18%2Binch%2BIN%2Bextensions%2Bhuman%Bhair&th=1; Reviewed by Amazon.com Dec. 6, 2016.

Photos of "Amy Collection Yaky Braid"; 3 views; unknown availability date to public but believed to be prior to filing of present application.

Photos of "Beauti Collection Platinum Yaki"; 3 views; unknown availability date to public but believed to be prior to filing of present application.

Photos of "Black Tide Professional Super Bulk Hair"; 3 views; unknown availability date to public but believed to be prior to filing of present application.

Photos of "Black Tide Professional Yaki Bulk Hair"; 3 views; unknown availability date to public but believed to be prior to filing of present application.

Photos of "Bobbie Boss Jumbo Braid"; 3 views; unknown availability date to public but believed to be prior to filing of present application.

Photos of "Epic Hot Water Braid"; 3 views; unknown availability date to public but believed to be prior to filing of present application.

Photos of "EZBraid Professional"; 3 views; unknown availability date to public but believed to be prior to filing of present application.

Photos of "Karizma Remi Yaki" Weave; 3 views; unknown availability date to public but believed to be prior to filing of present application.

Photos of "Linda U7" weave; 3 views; unknown availability date to public but believed to be prior to filing of present application.

Photos of "Que Jumbo Braid Premium Soft 2"; 3 views; unknown availability date to public but believed to be prior to filing of present application.

Photos of "Que Premium Soft Jumbo Braid"; 3 views; unknown availability date to public but believed to be prior to filing of present application.

Photos of "REMYTouch Interface Jumbo"; 3 views; unknown availability date to public but believed to be prior to filing of present application.

Photos of "Sensationnel Premium Wow" weave; 3 views; unknown availability date to public but believed to be prior to filing of present application.

Photos of "SuperLine Collection Silky Jumbo Braid"; 3 views; unknown availability date to public but believed to be prior to filing of present application.

Photos of "SuperLine Super Jumbo Braid"; 3 views; unknown availability date to public but believed to be prior to filing of present application.

Photos of "Urban Beauty Remi"; 3 views; unknown availability date to public but believed to be prior to filing of present application.

Photos of "Yaky Braid Femi"; 3 views; unknown availability date to public but believed to be prior to filing of present application.

"NonFinal OA", U.S. Appl. No. 14/640,936, filed Mar. 6, 2015; dated Aug. 23, 2016.

"Picture—Weaving Hair—Bottom", Photo of Weaving Hair; Bottom section: Unknown availability date but believed to be prior to filing of present application.

"Picture—Weaving Hair—Full Length", Photo of Weaving Hair; Full Length section: Unknown availability date but believed to be prior to filing of present application.

"Picture—Weaving Hair—Top", Photo of Weaving Hair; Top section Unknown availability date but believed to be prior to filing of present application.

"Publication", C Curl Remy Bob—Flyer; Eve Hair Inc.; Publication Date Unknown but believed to be prior to filing of present application.

Kalach, Brianne , "Final OA", U.S. Appl. No. 14/640,936, filed Mar. 6, 2015; dated Dec. 14, 2016.

Lucchesi, Nicholas , "NonFinal Office Action", U.S. Appl. No. 15/380,324, filed Dec. 15, 2016; dated Jun. 11, 2019.

Lucchesi, Nicholas , "NonFinal Office Action", U.S. Appl. No. 16/992,935, filed Aug. 13, 2020; dated Dec. 18, 2020.

Lucchesi, Nicholas , "NonFinal Office Action", U.S. Appl. No. 16/992,941, filed Aug. 13, 2020; dated Jan. 7, 2021.

Lucchesi, Nicholas , "Notice of Allowance", U.S. Appl. No. 15/380,324, filed Dec. 15, 2016; dated Apr. 8, 2020.

Raque, Samuel , "NonFinal Office Action", U.S. Appl. No. 15/853,844, filed Dec. 24, 2017; dated Mar. 20, 2020.

Thomas, Shane , "PCT Search Report", PCT Application No. PCT/US18/54482; Filed Oct. 25, 2018; dated Dec. 14, 2018.

Tsehaye, Rebecca , "NonFinal Office Action", U.S. Appl. No. 29/587,804, filed Dec. 15, 2016; dated May 22, 2019.

Tsehaye, Rebecca , "Notice of Allowance", U.S. Appl. No. 29/587,804, filed Dec. 15, 2016; dated Aug. 17, 2020.

* cited by examiner

-- PRIOR ART --

PACKAGED SYNTHETIC BRAIDING HAIR

CROSS REFERENCE TO PRIOR APPLICATIONS

This application is a continuation-in-part application claiming priority and benefit under 35 U.S.C. § 120 from U.S. application Ser. No. 16/992,935, filed Aug. 13, 2020, which is a continuation-in-part application claiming priority and benefit under 35 U.S.C. § 120 from U.S. application Ser. No. 15/380,324, filed Dec. 15, 2016, each of which is incorporated by reference for all purposes.

BACKGROUND

Technical Field

This disclosure relates generally to hair accessories, and more particularly to synthetic braiding hair.

Background Art

Hair accessories, including weaves and extensions, are becoming increasingly popular fashion accessories. Many people enjoy augmenting their natural hair with weaves, braids, or extensions.

Hair accessories generally come in two forms. In one form, human or synthetic hair is attached to a "weft." The weft is a natural or synthetic strip to which the hair is attached. The hair extends from a common side of the weft. When applying extensions using wefts of hair, the wefts are clipped, sewn, glued, or otherwise attached between rows of a person's natural hair to create stylistic effects, fashion effects, overall length, body, and so forth.

The second form is referred to as "braiding hair." Braiding hair is loose strands of synthetic hair that are bundled together and sold in a package. Rather than clipping, sewing, or gluing a weft to the wearer's head, with braiding hair the loose strands are braided into strands of the wearer's own hair much in the same way fibers are braided together to form a rope. The addition of the loose strands creates a lengthening effect as well as adding body to the wearer's own hair.

People using braiding hair are frequently discerning customers. They desire a natural look, and seldom wish to appear as if some mechanized process has been applied to their hair. It would be advantageous to have an improved braiding hair product and corresponding packaging to more readily meet these discerning customer needs.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
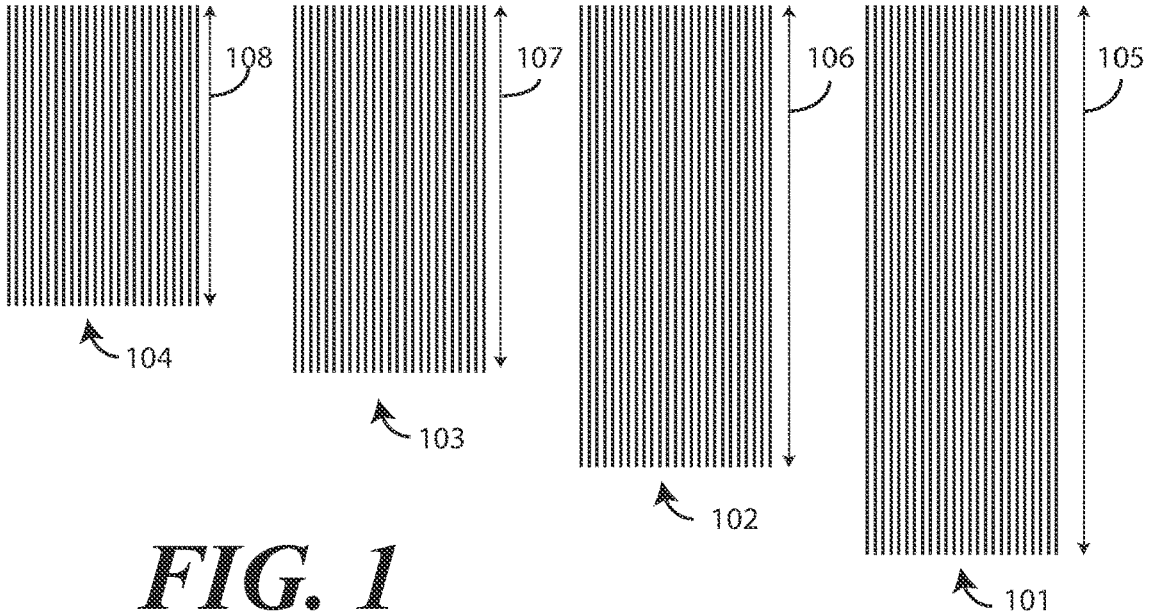
FIG. 1 illustrates braiding hair having different lengths in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. The terms "substantially" and "about" are used to refer to dimensions, orientations, or alignments inclusive of manufacturing tolerances. Thus, a "substantially orthogonal" angle with a manufacturing tolerance of plus or minus two degrees would include all angles between 88 and 92, inclusive. Also, reference designators shown herein in parenthesis indicate components shown in a figure other than the one in discussion. For example, talking about a device (10) while discussing figure A would refer to an element, 10, shown in figure other than figure A.

Figure 19:
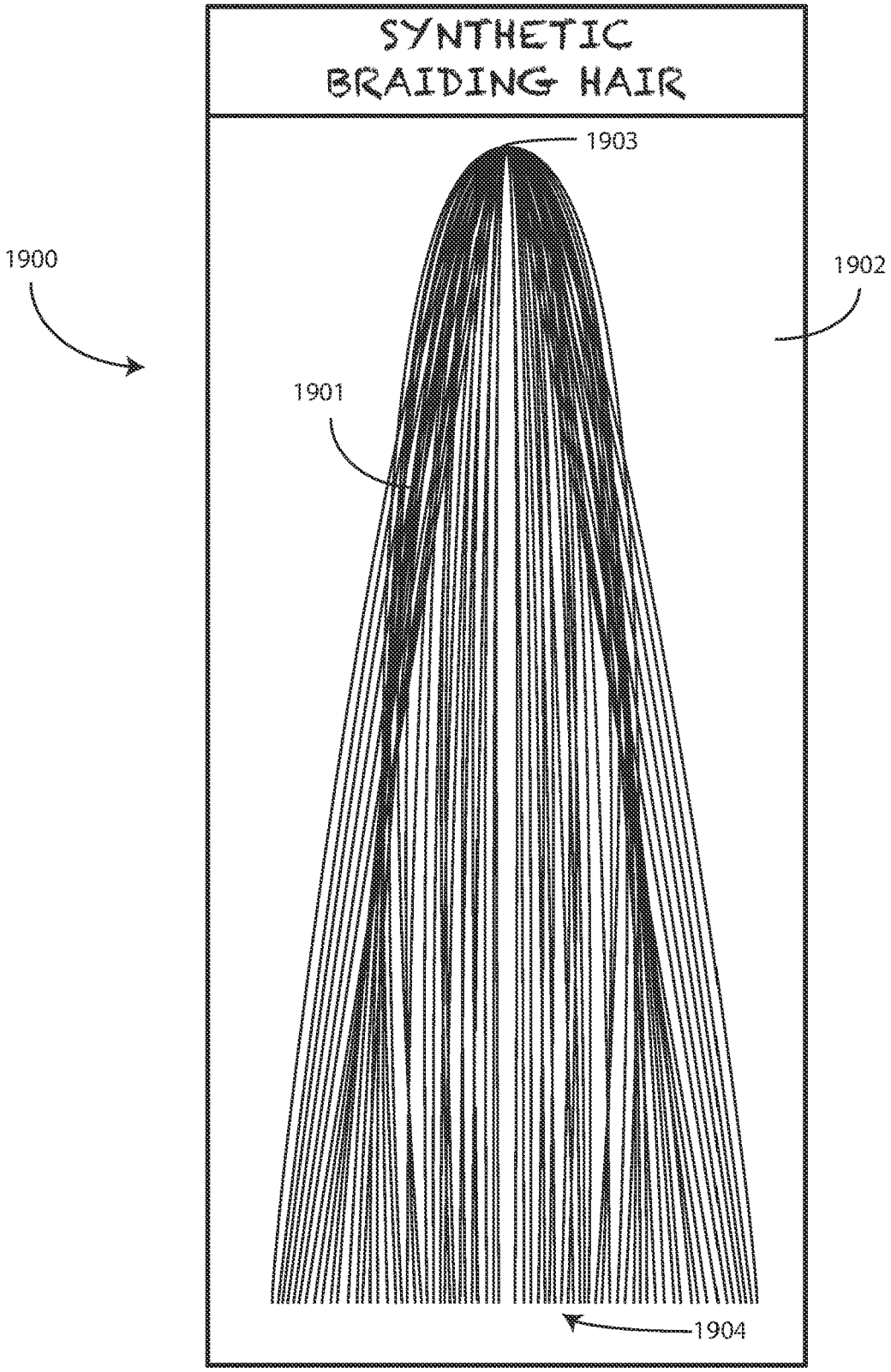
FIG. 19 illustrates prior art braiding hair.

Turning now to FIG. 19, illustrated therein is a prior art package 1900 of braiding hair 1901. A piece of cardboard 1902 supports the braiding hair 1901 with a twist tie 1903. Each strand of the braiding hair 1901 has exactly the same length. Each strand of the braiding hair 1901 is bundled with a common midpoint, which results in the ends each strand of the bundle of the braiding hair 1901 ending at the same point. Accordingly, in the folded configuration of FIG. 19, the base 1904 of the braiding hair 1901 is substantially flat. While slightly exaggerated in the drawing to clearly illustrate the substantially flat bottom with an image that will be reproducible in a published patent document, in practice the base 1904 of the braiding hair 1901, when bundled in this manner, appears substantially flat.

The reason that the base 1904 of the braiding hair 1901 is substantially flat is due to the manufacturing process. When the strands of braiding hair 1901 are manufactured, such as by spinning, extrusion, or other techniques, the fibers are all cut to a single length. This saves time and cost during manufacture and allows groups of strands to be cut simultaneously.

The problem with each strand of the braiding hair 1901 having the same length is that when it is bundled with a common midpoint, this constitutes an unnatural look. Consequently, hair stylists must "tease" the strands of braiding hair 1901 from the bundle in their hands to pull the ends of some strands back into their hand so that the ends of the braiding hair 1901, i.e., the base 1904, has a more natural look by being uneven. This is tedious and takes a tremendous amount of time. This teasing process must occur before the strands of braiding hair 1901 can be used.

Embodiments of the disclosure provide a solution that eliminates the need to manually tease braiding hair prior to use. To wit, in one or more embodiments, a plurality of bundles of braiding hair strands, each having a different length, are bundled together. For example, in one embodiment a first bundle of synthetic hair strands having a first length are bundled with a second bundle of synthetic hair strands having a second length that is shorter than the first length. Additional bundles can be added as well. For instance, a third bundle of synthetic hair strands having a third length that is shorter than the second length can be included with the first bundle and the second bundle. Similarly, a fourth bundle of synthetic hair strands having a fourth length that is shorter than the third length can be bundled with the first, second, and third bundles, and so forth.

In other embodiments, a plurality of bundles of braiding hair strands, each having a common length, are bundled together. However, rather than bundling the bundles of braiding hair strands at a common midpoint, each bundle of braiding hair strands is bundled with its center offset from each other bundle by at least a predefined distance. For example, in one embodiment a first bundle of synthetic hair strands having a predefined length are bundled with a second bundle of synthetic hair strands having that same predefined length. However, when the first bundle and the second bundle are bundled together, their centers are offset by at least a predefined distance. Additional bundles can be added as well, with the center of each additional bundle being offset from each other bundle by the predefined distance. For instance, a third bundle of synthetic hair strands having the predefined length and a center offset from the center of either the first bundle or the second bundle by the predefined distance can be included with the first bundle and the second bundle. Similarly, a fourth bundle of synthetic hair strands having the predefined length and a center offset from the centers of the first bundle, the second bundle, or the third bundle by the predefined distance can be bundled with the first, second, and third bundles, and so forth.

Regardless of which technique is used, i.e., bundling bundles of braiding hair having different lengths or bundling bundles of braiding hair having a common length where the center of each bundle is offset from the center of each other bundle by a predefined distance, once the bundled synthetic braiding hair is created, in one embodiment a binder, such as an elastic band, is optionally coupled about a waist of the bundled synthetic braiding hair. The bundled synthetic braiding hair can be folded about the waist. When this occurs, the outer perimeter of the folded bundled synthetic braiding hair defines, in one embodiment, a substantially cardioid shaped perimeter. More specifically, the side of the substantially cardioid shaped perimeter opposite a cusp side of the substantially cardioid shaped perimeter is rounded due to the fact that each sub-bundle of the bundled synthetic braiding hair has different lengths. In some embodiments, the side of the substantially cardioid shaped perimeter opposite the cusp side of the substantially cardioid shaped perimeter can define a pointed nadir due to the folding technique used. Either the rounded bottom or pointed nadir serves as a mnemonic device to inform a user that no teasing is necessary because the strands in the bundled synthetic braiding hair are all of different lengths, advantageously, providing for a more natural and beautiful appearance.

In some instances, the length of this substantially cardioid shaped perimeter will be longer than standard or available packaging. Illustrating by example, in one or more embodiments bundled synthetic braiding hair arranged to define a perimeter having a first end, a middle, and a second end located distally from the waist, where a width of the perimeter narrows as the bundled synthetic braiding hair extends from the middle to the second end, is packaged, optionally with a backer panel. However, embodiments of the disclosure that the length of this narrowing perimeter may be too long to fit in a particular package. To conveniently allow the bundled synthetic braiding hair to conveniently fit within the package, in one or more embodiments it is braided into a braid after being arranged to define the narrowing perimeter. This braiding shortens the length of the bundles of synthetic hair strands included with the bundled synthetic braiding hair, thereby making it more likely that the same will fit within a package. Where the braid is still too long for the package, the braid can be bent or folded, optionally about a midsection of the braid, to further shorten the overall length of the construct.

Turning to FIG. 1, illustrated therein are four bundles of synthetic braiding hair. Each bundle comprises a plurality of synthetic hair strands. As shown, there is a first bundle 101 of synthetic braiding hair strands, a second bundle 102 of synthetic braiding hair strands, a third bundle 103 of synthetic braiding hair strands, and a fourth bundle 104 of synthetic braiding hair strands. As will be described in more detail below, the four bundles of synthetic braiding hair can be bundled together to create bundled synthetic braiding hair. It should be noted that while four bundles of synthetic braiding hair are shown for ease of illustration in FIG. 1, bundled synthetic braiding hair assemblies configured in accordance with embodiments of the disclosure can have fewer than four bundles or more than four bundles as well.

The synthetic strands in each bundle have a corresponding length. For example, the first bundle 101 of synthetic hair strands has a first length 105, while the second bundle 102 of synthetic hair strands has a second length 106. Similarly, the third bundle 103 of synthetic hair strands has a third length 107, while the fourth bundle 104 of synthetic hair strands has a fourth length 108. In one or more embodiments, each synthetic strand in each bundle has a common length, but this common length is different from the lengths of synthetic strands in other bundles. For instance, all the synthetic strands in the first bundle 101 can have substantially a common length, which is the first length 105. However, these synthetic strands will have different lengths when compared to synthetic strands in the second bundle 102, the third bundle 103, the fourth bundle 104, and so forth.

In one or more embodiments, the length of each bundle of synthetic strands is different from the others. In this illustrative embodiment, the first length 105 of the first bundle 101 of synthetic hair strands is longer than the second length 106 of the second bundle 102 of synthetic hair strands. Said differently, the second bundle 102 of synthetic hair synthetic hair strands has a second length 106 that is shorter than the first length 105. Similarly, the third bundle 103 of synthetic hair strands has a third length 107 that is shorter than the second length 106, while the fourth bundle 104 of synthetic hair strands has a fourth length 108 that is shorter than the third length 107.

The first length 105, the second length 106, the third length 107, and the fourth length 108 can be any of a number of lengths. In one embodiment, the first length 105 is one of sixty inches, fifty inches, forty inches, and thirty inches. Said differently, in one embodiment the first length 105 is selected from the group consisting of sixty inches, fifty inches, forty inches, and thirty inches.

In one or more embodiments, each subsequent length is then two inches shorter than the former. Thus, in one or more embodiments, the second length 106 is two inches shorter than the first length 105. Similarly, the third length 107 is two inches shorter than the second length 106, and the fourth length 108 is two inches shorter than the third length 107. This difference between the first length 105, the second length 106, the third length 107, and the fourth length 108 is illustrative only, as other differences that are greater than, or shorter than, two inches will be obvious to those of ordinary skill in the art having the benefit of this disclosure.

For example, in one embodiment where the first length 105 is sixty inches, the second length 106 is fifty-eight inches, the third length 107 is fifty-six inches, and the fourth length 108 is fifty-four inches. In another embodiment where the first length 105 is fifty inches, the second length 106 is forty-eight inches, the third length 107 is forty-six inches, and the fourth length 108 is forty-four inches. In another embodiment where the first length 105 is forty inches, the second length 106 is thirty-eight inches, the third length 107 is thirty-six inches, and the fourth length 108 is thirty-four inches. These dimensions are illustrative only, as others will be obvious to those of ordinary skill in the art having the benefit of this disclosure.

Figure 2:
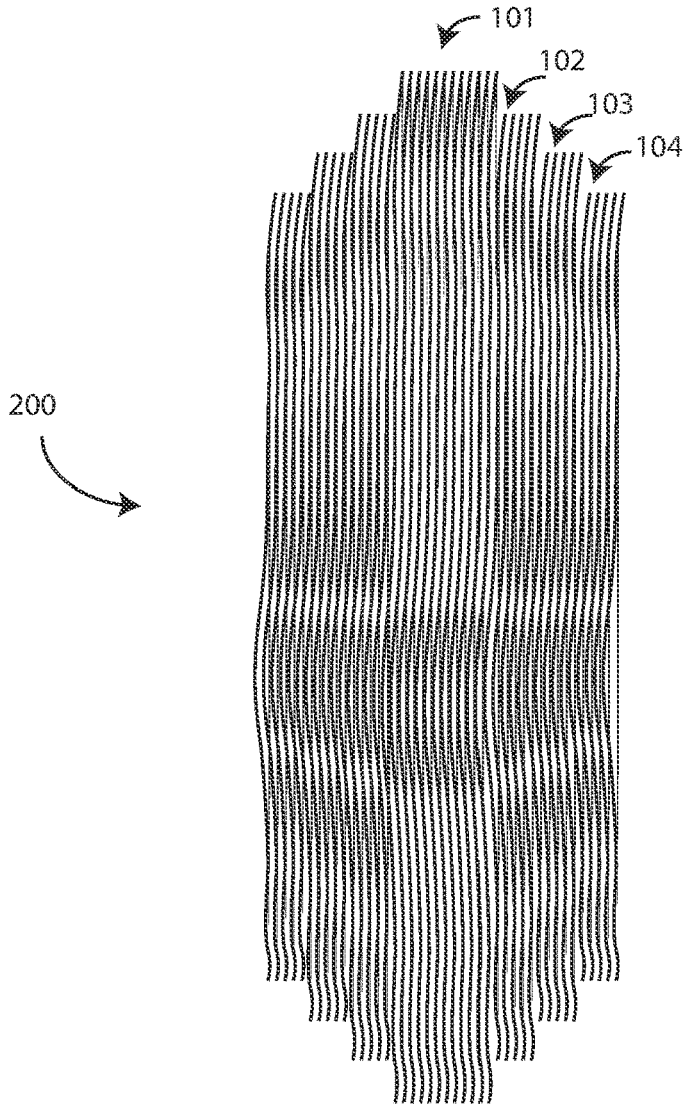
FIG. 2 illustrates braiding hair having different lengths being bundled in accordance with one or more embodiments of the disclosure.

Turning now to FIG. 2, the first bundle 101 of synthetic hair strands, the second bundle 102 of synthetic hair strands, the third bundle 103 of synthetic hair strands, and the fourth bundle 104 of synthetic hair strands are assembled together to form a braiding hair assembly 200. In one or more embodiments, this braiding hair assembly 200 can be "hackled," which involves pulling the bundles of hair strands through a bed of metal or plastic spikes. The friction between the strands of hair and the spikes functions as a comb, effectively evenly distributing the various hair strands throughout the braiding hair assembly 200. Once the braiding hair assembly 200 is bundled together, and optionally hackled, thereby distributing strands from the first bundle 101 of synthetic hair strands, the second bundle 102 of synthetic hair strands, the third bundle 103 of synthetic hair strands, and the fourth bundle 104 of synthetic hair strands evenly across the braiding hair assembly 200, a bundled synthetic braiding hair accessory is formed, one example of which is shown in FIG. 3.

Figure 3:
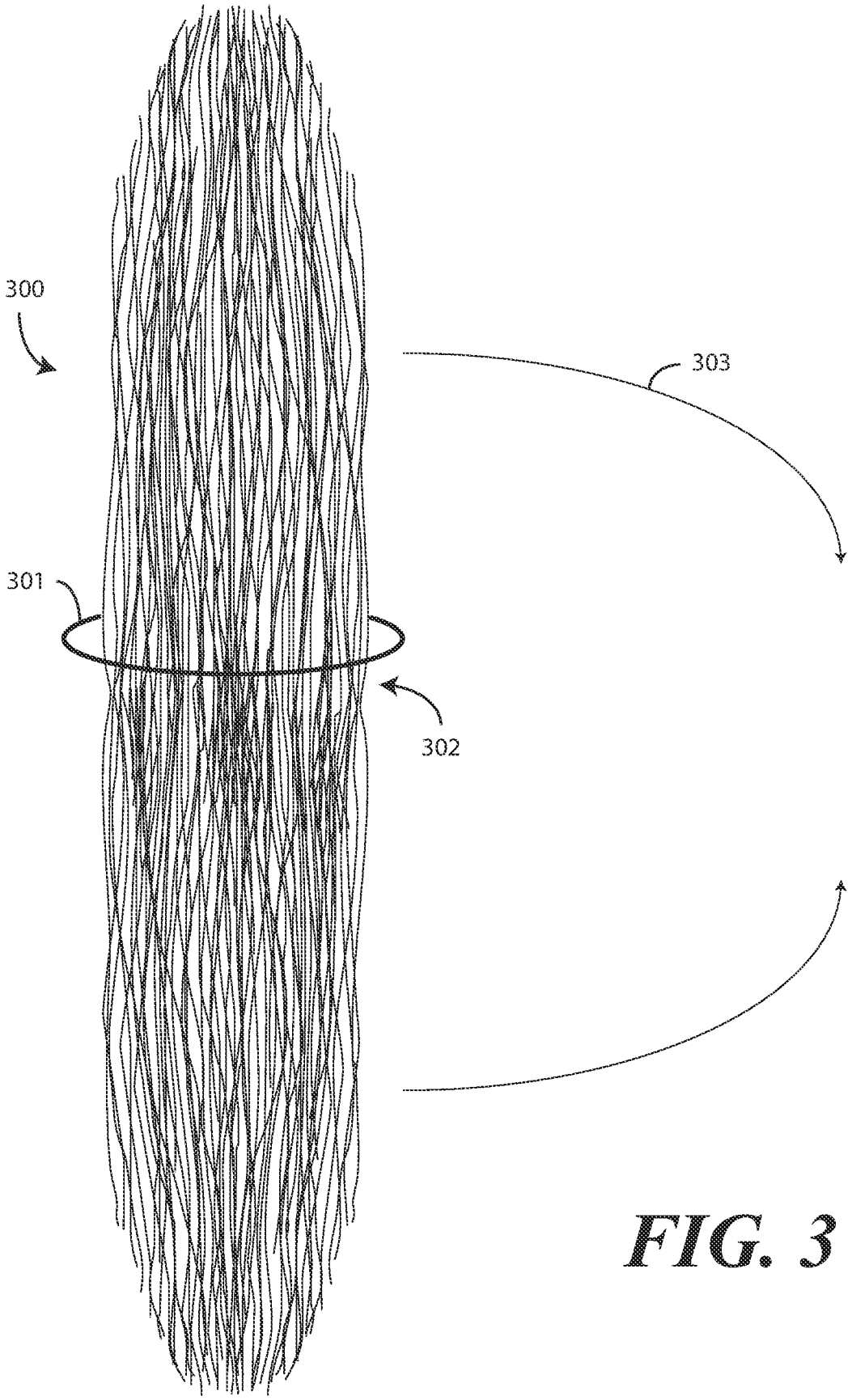
FIG. 3 illustrates bundled braiding hair being bound and folded in accordance with one or more embodiments of the disclosure.

Turning now to FIG. 3, illustrated therein is bundled synthetic braiding hair 300 comprising at least the first bundle (101) of synthetic hair strands, the second bundle (102) of synthetic hair strands, the third bundle (103) of synthetic hair strands, and the fourth bundle (104) of synthetic hair strands. Once the bundled synthetic braiding hair 300 is formed a binder 301 can optionally be coupled about a waist 302 of the bundled synthetic braiding hair 300. The binder 301 can be an elastic band, a rubber band, a zip-strip, a twist tie, or a plastic strip. Other examples of binders will be obvious to those of ordinary skill in the art having the benefit of this disclosure.

In one or more embodiments, the bundled synthetic braiding hair 300 is then folded 303 about the waist 302. In one embodiment, the bundled synthetic braiding hair 300 is folded 303 about the waist 302 after the binder 301 is coupled about the waist 302. In other embodiments, the bundled synthetic braiding hair 300 is folded 303 about the waist 302 prior to coupling the binder 301 about the waist 302. The resulting folded bundled synthetic braiding hair is shown in FIG. 4.

Figure 4:
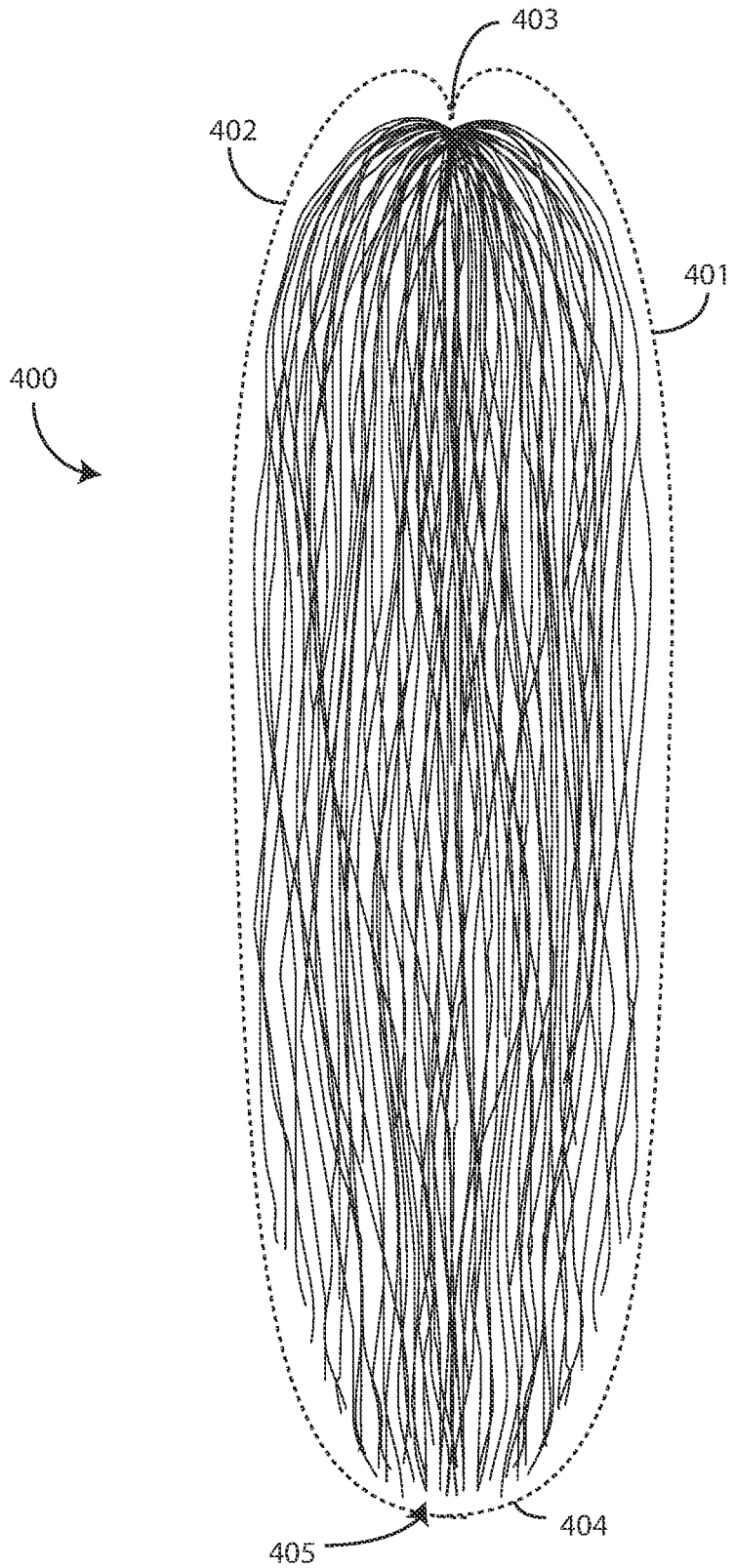
FIG. 4 illustrates bound, bundled, and folded braiding hair in accordance with one or more embodiments of the disclosure.

As shown in FIG. 4, the folded bundled synthetic braiding hair 400 defines a substantially cardioid shaped perimeter 401. The term "substantially" is used because while the substantially cardioid shaped perimeter 401 is not a perfect cardioid as would be the case when a circle of fixed radius is rotated about another circle with a point at the intersection of the fixed radius drawing the cardioid, it has a cardioid appearance in that it includes a cusp 403 and two cardioidal lobes. The substantially cardioid shaped perimeter 401 also resembles an inverted teardrop with a rounded end instead of a pointed one.

In this illustrative embodiment, the substantially cardioid shaped perimeter 401 has a first side 402 with a cusp 403 and a second side 404, which is disposed opposite the first side 402 having the cusp 403. In one or more embodiments, the second side 404 is rounded due to the fact that the synthetic strands in each of the first bundle (101) of synthetic hair strands, the second bundle (102) of synthetic hair strands, the third bundle (103) of synthetic hair strands, and the fourth bundle (104) of synthetic hair strands have different lengths. Thus, in contrast to the prior art package (1900) of braiding hair (1901), which had a base (1904) of the braiding hair (1901) that was substantially flat, in embodiments of the disclosure the base 405 of the folded bundled synthetic braiding hair 400 is rounded. This serves as a mnemonic device to inform a user that no teasing before use is required because the strands in the bundled synthetic braiding hair are all of different lengths. This advantageously saves time and effort for the technician, while providing a more natural and beautiful appearance for the end user.

Figure 5:
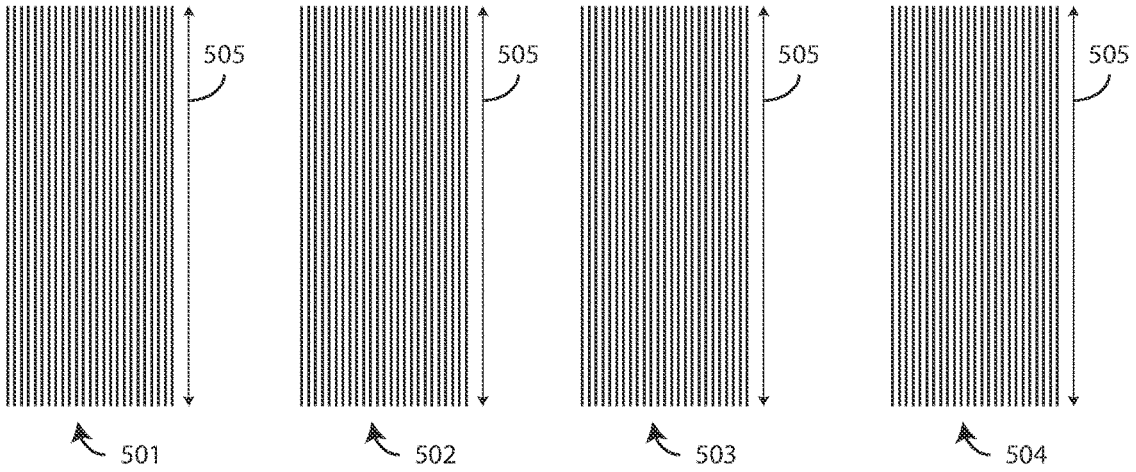
FIG. 5 illustrates braiding hair having common lengths in accordance with one or more embodiments of the disclosure.

Turning to FIG. 5, illustrated therein are again four bundles of synthetic braiding hair. Each bundle comprises a plurality of synthetic hair strands. As shown, there is a first bundle 501 of synthetic braiding hair strands, a second bundle 502 of synthetic braiding hair strands, a third bundle 503 of synthetic braiding hair strands, and a fourth bundle 504 of synthetic braiding hair strands. As will be described in more detail below, the four bundles of synthetic braiding hair can be bundled together to create bundled synthetic braiding hair. It should be noted that while four bundles of synthetic braiding hair are shown for ease of illustration in FIG. 5, bundled synthetic braiding hair assemblies configured in accordance with embodiments of the disclosure can have fewer than four bundles or more than four bundles as well.

The synthetic strands in each bundle have a common length 505. For example, the first bundle 501 of synthetic hair strands, the second bundle 502 of synthetic hair strands, the third bundle 503 of synthetic hair strands, and the fourth bundle 504 of synthetic hair strands each have the common length 505 in FIG. 5. In one or more embodiments, each synthetic strand in each bundle has a common length 505, which is the same as the lengths of synthetic strands in other bundles. For instance, all the synthetic strands in the first bundle 501 can have substantially a common length 505, which is the same length as those synthetic strands found in the second bundle 502, the third bundle 503, the fourth bundle 504, and so forth.

The common length 505 can be any of a number of lengths. In one embodiment, the common length 505 is one of sixty inches, fifty inches, forty inches, and thirty inches. Said differently, in one embodiment the common length 505 is selected from the group consisting of sixty inches, fifty inches, forty inches, and thirty inches.

Figure 6:
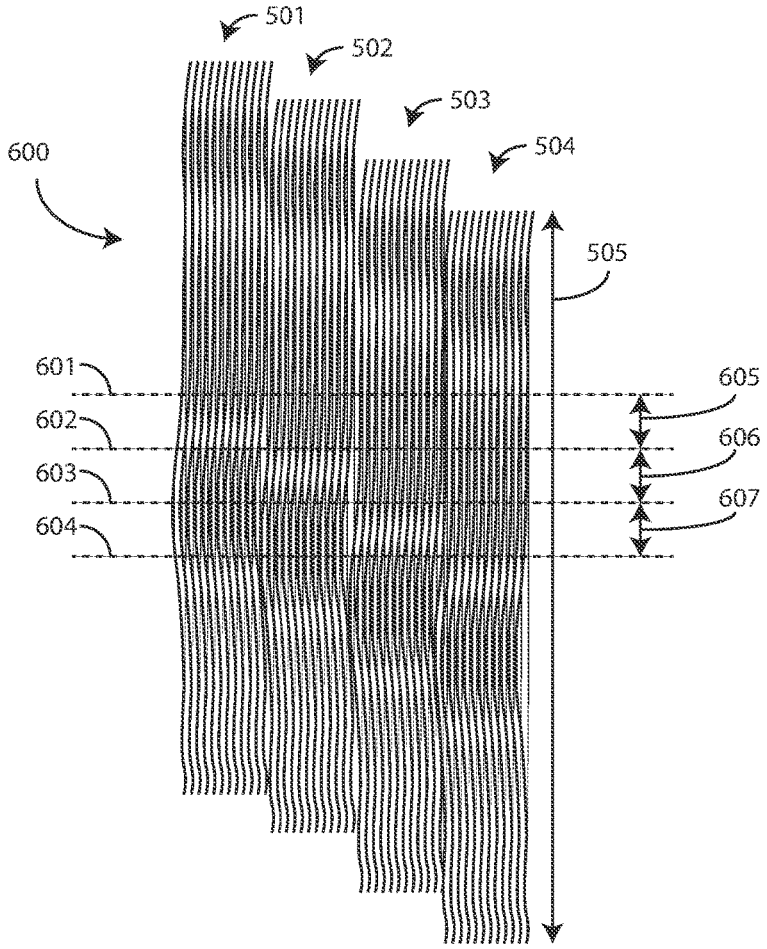
FIG. 6 illustrates braiding hair having common lengths being bundled in accordance with one or more embodiments of the disclosure.

Turning now to FIG. 6, so as to ultimately end up with folded bundled synthetic braiding hair defines a substantially cardioid shaped perimeter, when the first bundle 501, the second bundle 502, the third bundle 503, and the fourth bundle 504 are bundled, their centers 601,602,603,604 are offset relative to each other center by a predefined distance 605,606,606. Illustrating by example, as shown in FIG. 6 the center 601 of the first bundle 501 is offset by from the center 602 of the second bundle 502 by a first predefined distance 605, while the center 603 of the third bundle 503 is offset from the center 602 of the second bundle 502 by a second predefined distance 606. The center 604 of the fourth bundle 504 is offset from the center 603 of the third bundle 503 by another predefined distance 607, and so forth.

In one or more embodiments, each predefined distance 605,606,607 of offset is the same. Illustrating by example, in one or more embodiments each predefined distance 605, 606,607 is two inches. Thus, in one or more embodiments, the center 601 of the first bundle 501 is offset by from the center 602 of the second bundle 502 by two inches, while the center 603 of the third bundle 503 is also offset from the center 602 of the second bundle 502 by two inches. The center 604 of the fourth bundle 504 is offset from the center 603 of the third bundle 503 by another two inches, and so forth.

In other embodiments each predefined distance 605,606, 607 is different. For instance, in one or more embodiments, the center 601 of the first bundle 501 may be offset by from the center 602 of the second bundle 502 by one inch, while the center 603 of the third bundle 503 is offset from the center 602 of the second bundle 502 by two inches. The center 604 of the fourth bundle 504 is offset from the center 603 of the third bundle 503 by an inch and a half, and so forth. These examples of predefined distances 605,606,607, whether common or different, are illustrative only, as other predefined distance 605,606,607 will be obvious to those of ordinary skill in the art having the benefit of this disclosure. For example, in one embodiment where the common length 505 of the hair strands is sixty inches, the predefined distances 605,606,607 may be shorter than when the common length 505 is fifty-six inches, or vice versa.

As shown in FIG. 6, the first bundle 501 of synthetic hair strands, the second bundle 502 of synthetic hair strands, the third bundle 503 of synthetic hair strands, and the fourth bundle 504 of synthetic hair strands are assembled together with their centers 601,602,603,604 offset relative to each other center by a predefined distance 605,606,606 to form a braiding hair assembly 600.

As previously described, in one or more embodiments this braiding hair assembly 600 can then be hackled, thereby evenly distributing the various hair strands throughout the braiding hair assembly 600. In one or more embodiments, the hackling causes the various strands of hair from the first bundle 501 of synthetic hair strands, the second bundle 502 of synthetic hair strands, the third bundle 503 of synthetic hair strands, and the fourth bundle 504 to separate and unevenly overlap as shown below in FIG. 7.

Figure 7:
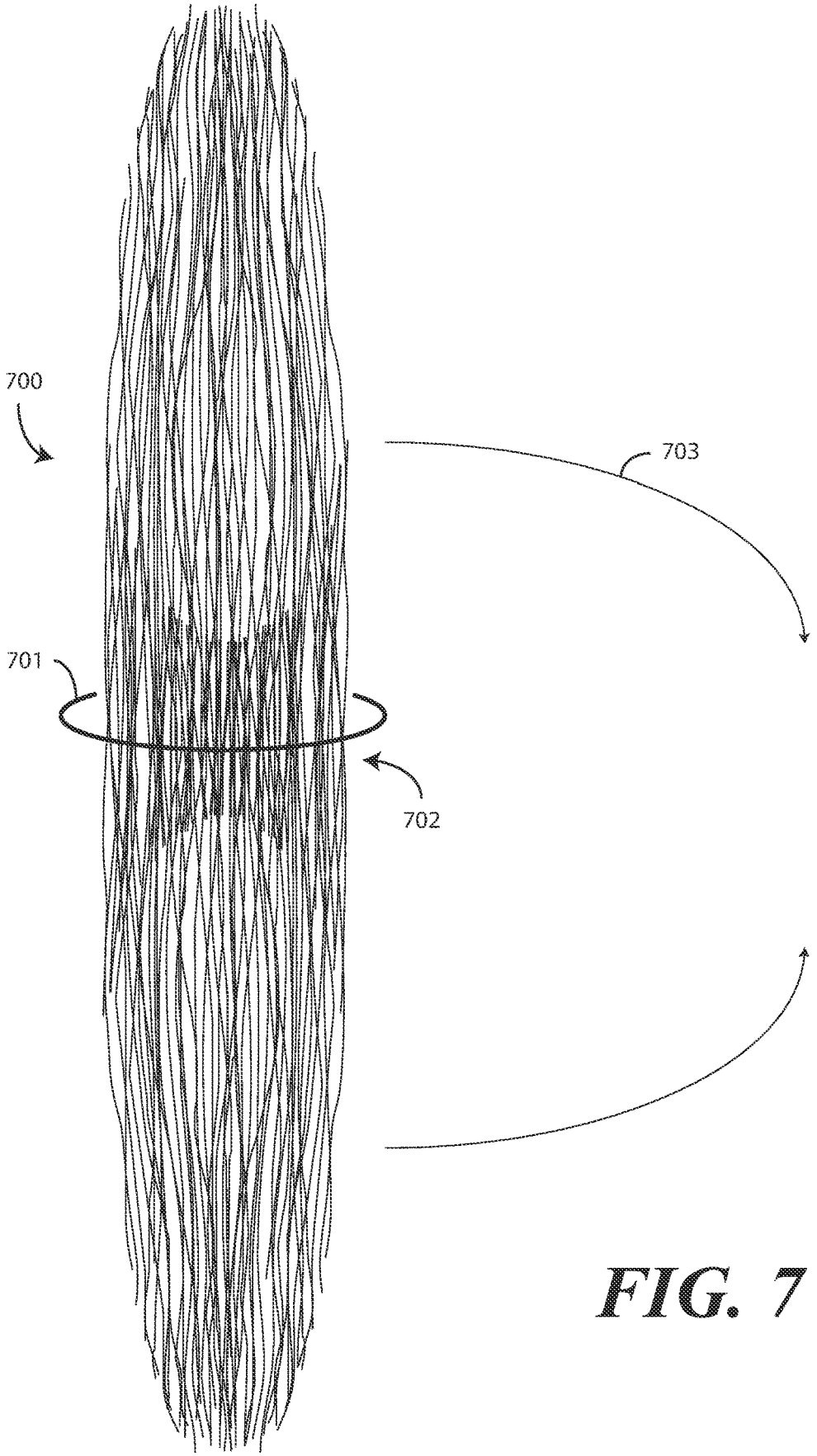
FIG. 7 illustrates bundled braiding hair being bound and folded in accordance with one or more embodiments of the disclosure.

Once the braiding hair assembly 600 is bundled together with centers 601,602,603,604 of the first bundle 501 of synthetic hair strands, the second bundle 502 of synthetic hair strands, the third bundle 503 of synthetic hair strands, and the fourth bundle 504 of synthetic hair strands offset relative to each other center by a predefined distance 605, 606,606, and optionally hackled, thereby distributing strands from the first bundle 501 of synthetic hair strands, the second bundle 502 of synthetic hair strands, the third bundle 503 of synthetic hair strands, and the fourth bundle 504 of synthetic hair strands evenly across the braiding hair assembly 600, a bundled synthetic braiding hair accessory is formed, one example of which is shown in FIG. 7.

Turning now to FIG. 7, illustrated therein is another bundled synthetic braiding hair 700 comprising at least the first bundle (501) of synthetic hair strands, the second bundle (502) of synthetic hair strands, the third bundle (503) of synthetic hair strands, and the fourth bundle (504) of synthetic hair strands bundled together with centers (601, 602,603,604) of the first bundle (501) of synthetic hair strands, the second bundle (502) of synthetic hair strands, the third bundle (503) of synthetic hair strands, and the fourth bundle (504) of synthetic hair strands offset relative to each other center by a predefined distance (605,606,606). Once the bundled synthetic braiding hair 700 is formed a binder 701 can optionally be coupled about a waist 702 of the bundled synthetic braiding hair 700. As before, the binder 701 can be an elastic band, a rubber band, a zip-strip, a twist tie, or a plastic strip. Other examples of binders will be obvious to those of ordinary skill in the art having the benefit of this disclosure.

In one or more embodiments, the bundled synthetic braiding hair 700 is then folded 703 about the waist 702. In this illustrative embodiment, the waist 702 is defined at a section of uneven overlap resulting from the hackling process.

In one embodiment, the bundled synthetic braiding hair 700 is folded 703 about the waist 702 after the binder 701 is coupled about the waist 702. In other embodiments, the bundled synthetic braiding hair 700 is folded 703 about the waist 702 prior to coupling the binder 701 about the waist 702. The resulting folded bundled synthetic braiding hair is shown in FIG. 8.

Figure 8:
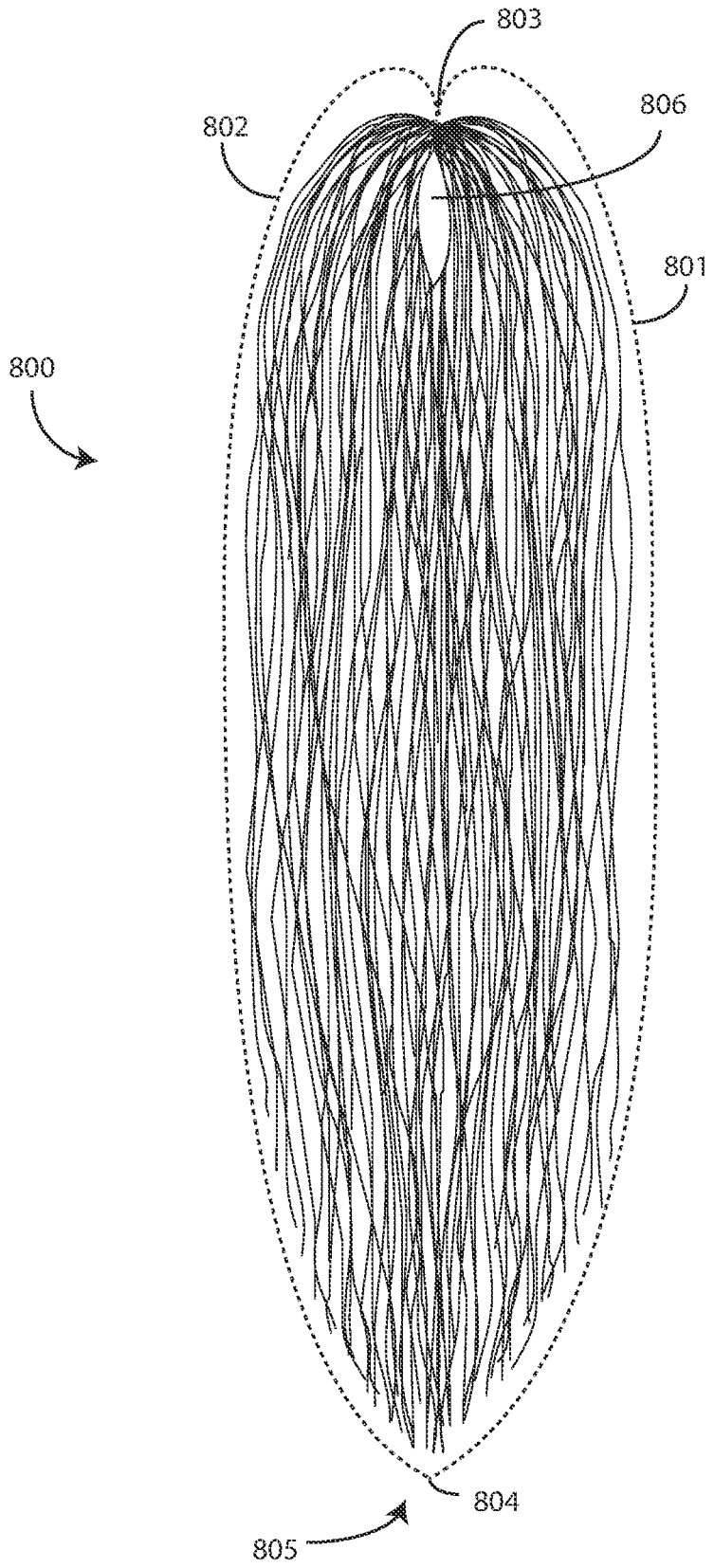
FIG. 8 illustrates bound, bundled, and folded braiding hair in accordance with one or more embodiments of the disclosure.

As shown in FIG. 8, the folded bundled synthetic braiding hair 800 defines a substantially cardioid shaped perimeter 801. An optional aperture 806 may be defined in the folded bundled synthetic braiding hair 800 as a result of the folding process used. The substantially cardioid shaped perimeter 801 of FIG. 8 is a bit farther from a perfect cardioid than was the substantially cardioid shaped perimeter (401) of FIG. 4 due to the sharper nadir 805 defined at the second side 804 of the substantially cardioid shaped perimeter 801. This pointed nadir 805 results, in one or more embodiments, from the folding process used in FIG. 7. As before, the substantially cardioid shaped perimeter 801 includes a cusp 803 and two cardioidal lobes. The substantially cardioid shaped perimeter 801 also resembles an inverted teardrop with a pointed end rather than a rounded end. The folding process of FIG. 3 could be used instead of the folding process of FIG. 7 if a more rounded end is desired.

In this illustrative embodiment, the substantially cardioid shaped perimeter 801 has a first side 802 with a cusp 803 and a second side 804, which is disposed opposite the first side 802 having the cusp 803. In one or more embodiments, the second side 804 is rounded due to the fact that the synthetic strands in each of the first bundle (501) of synthetic hair strands, the second bundle (502) of synthetic hair strands, the third bundle (103) of synthetic hair strands, and the fourth bundle (504) of synthetic hair strands had their centers (601,602,603,604) offset relative to each other center by a predefined distance (605,606,606). An example of a rounded second side is shown in FIG. 6 above. In other embodiments, the second side 804 includes the nadir 805 shown in FIG. 8.

Thus, in contrast to the prior art package (1900) of braiding hair (1901), which had a base (1904) of the braiding hair (1901) that was substantially flat, in embodiments of the disclosure the second side 804 of the folded bundled synthetic braiding hair 800 is pointed. This serves as a mnemonic device to inform a user that no teasing before use is required because the strands in the bundled synthetic braiding hair are offset relative to others by at least a predefined distance. As with the embodiment of FIGS. 1-4, this advantageously saves time and effort for the technician, while providing a more natural and beautiful appearance for the end user.

Figure 9:
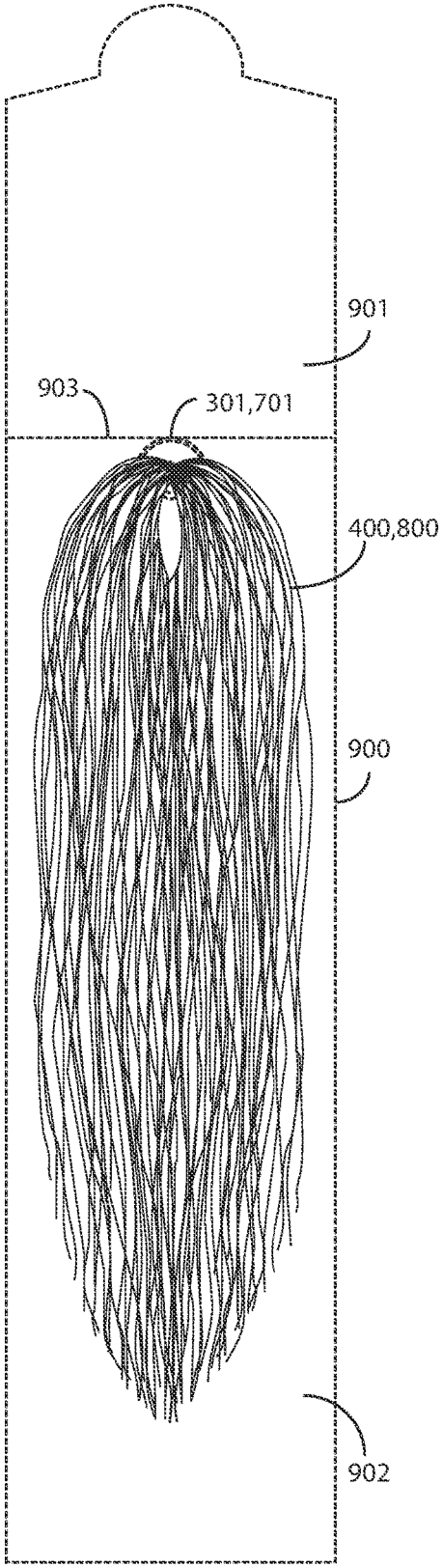
FIG. 9 illustrates bound, bundled, and folded braiding hair attached to a package in accordance with one or more embodiments of the disclosure.

Turning now to FIG. 9, illustrated therein is the folded bundled synthetic braiding hair with a backer panel 900. In one or more embodiments, the folded, bundled synthetic braiding hair can be packaged with the backer panel 900. The folded bundled synthetic braiding hair packaged, optionally with the backer panel 900, could be the folded bundled synthetic braiding hair 400 of FIG. 4 or the folded bundled synthetic braiding hair 800 of FIG. 8. Alternatively, the folded bundled synthetic braiding hair could be the folded bundled synthetic braiding hair 400 of FIG. 4 folded with the folding process of FIG. 7, thereby resulting in a more pointed end, or the folded bundled synthetic braiding hair 800 of FIG. 7 folded with the folding process of FIG. 3, thereby resulting in a rounder end. Moreover, as will be described below with reference to FIGS. 17-18, in other embodiments the folded, bundled synthetic braiding hair can be braided into a braid, thereby shortening the overall length, prior to packaging with or without the backer panel 900. If the braid is still too long for the packaging, the braid can be bent, folded, or folded about a midsection of the braid to still further reduce the overall length as well. Other post-folding operations suitable for making the folded, bundled synthetic braiding hair more easy to package will be obvious to those of ordinary skill in the art having the benefit of this disclosure.

In one or more embodiments, the backer panel 900 can be manufactured from cardboard, plastic, paper, or other materials. The backer panel 900 can be opaque, translucent, or transparent. In this illustrative embodiment, the binder 301, 701 is coupled to the backer panel 900.

In one or more embodiments, the backer panel 900 spans at least some of the folded bundled synthetic braiding hair 400,800. Where the folded bundled synthetic braiding hair 400,800 is braided into a braid, the backer panel 900 can span at least some of the braid. In this illustrative embodiment, the backer panel 900 includes a first portion 901 and a second portion 902. The first portion 901 and the second portion 902 intersect at a fold line 903 in one embodiment. The first portion 901 can fold relative to the second portion 902 about the fold line 903 so as to at least partially cover the folded bundled synthetic braiding hair 400,800.

Figure 10:
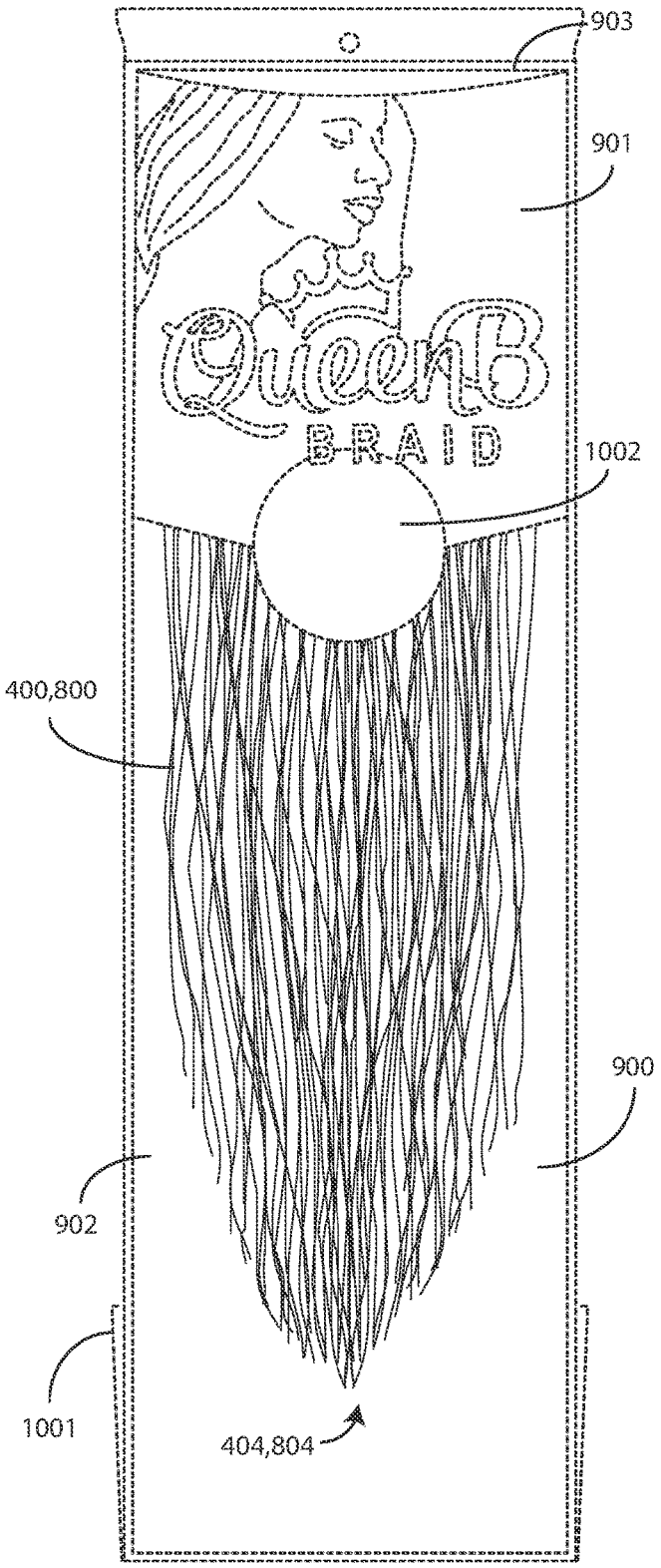
FIG. 10 illustrates packaged braiding hair in accordance with one or more embodiments of the disclosure.

Turning now to FIG. 10, in one embodiment the second portion 902 is longer than the folded bundled synthetic braiding hair 400,800, while the first portion 901 is shorter than the folded bundled synthetic braiding hair 400,800. Accordingly, when the first portion 901 is folded about the fold line 903 relative to the second portion, the second portion 902 completely spans a first side (oriented into the page) of the folded bundled synthetic braiding hair 400,800, while the first portion 901 only partially spans a second side (oriented out of the page) of the folded bundled synthetic braiding hair 400,800. When this occurs, a second side 404,804 of the substantially cardioid shaped perimeter (401, 801) of the folded bundled synthetic braiding hair 400,800 is visible. Said differently, as shown in FIG. 10, the second side 404,804 of the substantially cardioid shaped perimeter (401,801) disposed opposite a cusp side, e.g. the first side of the of the substantially cardioid shaped perimeter (401,801), is exposed beneath the first portion 901 of the backer panel 900 partially spanning the second side of the folded bundled synthetic braiding hair 400,800.

A container 1001 or package can then be disposed about the folded bundled synthetic braiding hair 400,800 and, optionally where included, the backer panel 900. The completed assembly is now ready for sale to a consumer. Advantageously, the consumer can readily identify the fact that the folded bundled synthetic braiding hair 400,800 includes either hair of different lengths or hair of a common length with offset centers in the bundle, and thus requires no teasing prior to use. This is readily identifiable due to the exposure of the second side 404,804 of the substantially cardioid shaped perimeter (401,801) of the folded bundled synthetic braiding hair 400,800 beneath the first portion 901 of the backer panel 900.

In one or more embodiments, a length of the longest strand is indicated on a length medallion 1002. Accordingly, the consumer can determine the length of the longest strand, e.g., 60", by reading the length medallion 1002 to make an informed and educated purchase. In one or more embodiments, whether the folded bundled synthetic braiding hair 400,800 was made using hair of different lengths or hair of a common length with offset centers is also set forth on either the length medallion 1002 or the outer surface of the first portion 901 of the backer panel 900.

Figure 11:
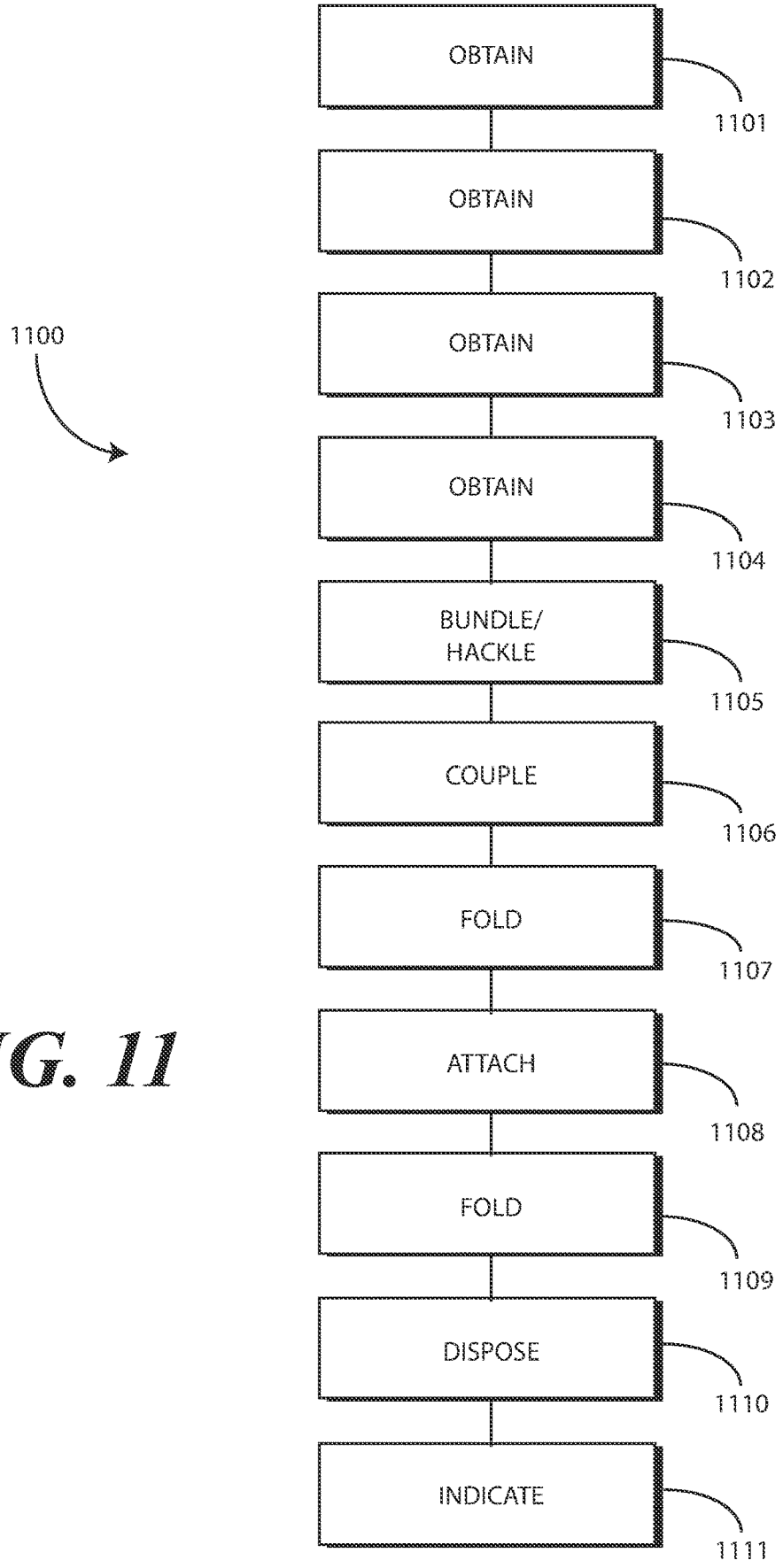
FIG. 11 illustrates one explanatory method in accordance with one or more embodiments of the disclosure.

Turning now to FIG. 11, illustrated therein is one method 1100 in accordance with one or more embodiments of the disclosure. Beginning at step 1101, the method 1100 includes obtaining a first bundle of synthetic hair stands having a first length. At step 1102, the method 1100 includes obtaining a second bundle of synthetic hair strands having a second length that is shorter than the first length.

At optional step 1103, the method 1100 includes obtaining a third bundle of synthetic hair strands having a third length that is shorter than the second length. At optional step 1104, the method 1100 includes obtaining a fourth bundle of synthetic hair strands having a fourth length that is shorter than the third length. Additional bundles beyond the fourth bundle can optionally be obtained as well.

At step 1105, the method 1100 includes bundling the first bundle and the second bundle to form bundled synthetic braiding hair. In one or more embodiments, step 1105 further comprises hackling the first bundle and the second bundle as noted above. Where step 1103 is included, the bundling of step 1105 comprises bundling the third bundle with the first bundle and the second bundle. Where step 1104 is included, the bundling of step 1105 comprises bundling the fourth bundle with the first bundle and the second bundle and the third bundle. Where additional bundles are included, they can be bundled with the others at step 1105 as well. Where step 1103 includes bundling one or more of the third bundle and the fourth bundle, step 1105 can include hackling these bundles as well.

At step 1106, the method 1100 optionally comprises coupling a binder about a waist of the bundled synthetic braiding hair. At step 1107, the method 1100 includes folding the bundled synthetic braiding hair about the binder to define a substantially cardioid shaped perimeter.

At optional step 1108, the method 1100 optionally includes attaching the binder to a backer panel. At optional step 1109, the method 1100 includes folding the backer panel about the binder so that a first portion of the backer panel completely spans a first side of the bundled synthetic braiding hair and a second portion of the backer panel partially spans a second side of the bundled synthetic braiding hair.

At optional step 1110, the method 1100 includes disposing the backer panel in a package. In one embodiment, this disposition is such that a second side of the substantially cardioid shaped perimeter disposed opposite a cusp side of the substantially cardioid shaped perimeter is exposed beneath the second portion of the backer panel. At optional step 1111, the method 1100 can include indicating the first length on the second portion of the backer panel.

Figure 12:
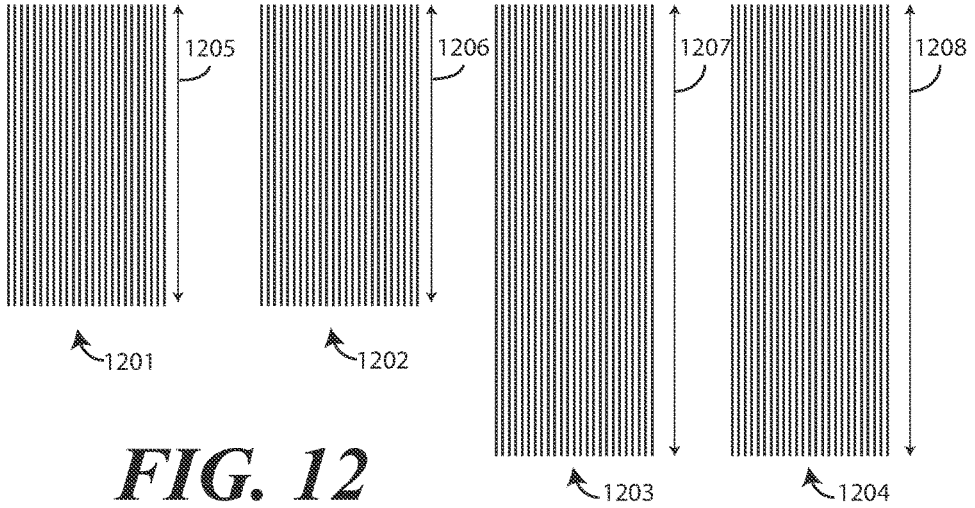
FIG. 12 illustrates braiding hair having different lengths in accordance with one or more embodiments of the disclosure.

Turning now to FIG. 12, illustrated therein are four bundles of synthetic braiding hair. Each bundle comprises a plurality of synthetic hair strands. As shown, there is a first bundle 1201 of synthetic braiding hair strands, a second bundle 1202 of synthetic braiding hair strands, a third bundle 1203 of synthetic braiding hair strands, and a fourth bundle 1204 of synthetic braiding hair strands. While four bundles of synthetic braiding hair are shown in this illustrative embodiment, bundled synthetic braiding hair assemblies configured in accordance with embodiments of the disclosure can have fewer than four bundles or more than four bundles as well. For example, in one embodiment a bundled synthetic braiding hair assembly includes only the first bundle 1201 and the third bundle 1203. In another embodiment, two bundles of each of the first bundle 1201, the second bundle 1202, the third bundle 1203, and the fourth bundle 1204 can be used. Other combinations will be obvious to those of ordinary skill in the art having the benefit if this disclosure.

In this illustrative embodiment, the synthetic strands in each bundle have a corresponding length. For example, the first bundle 1201 of synthetic hair strands has a first length 1205, while the second bundle 1202 of synthetic hair strands has a second length 1206. Similarly, the third bundle 1203 of synthetic hair strands has a third length 1207, while the fourth bundle 1204 of synthetic hair strands has a fourth length 1208. In one or more embodiments, each synthetic strand in each bundle has a common length, but this common length is different from the lengths of synthetic strands in at least one other bundle. However, in this illustrative embodiment the first bundle 1201 and the second bundle 1202 have a common length, while the third bundle 1203 and the fourth bundle 1204 also have a common length that is different from the common length of the first bundle 1201 and the second bundle 1202.

For instance, in this embodiment all the synthetic strands in the first bundle 1201 can have substantially a common length, which is the first length 1205. Similarly, all the strands in the second bundle 1202 have substantially a common length, which is the second length 1206. In this embodiment, the first length 1205 and the second length 1206 are substantially the same.

Similarly, all the synthetic strands in the third bundle 1203 can have substantially a common length, which is the third length 1207. All the strands in the fourth bundle 1204 have substantially a common length, which is the fourth length 1208. In this embodiment, the third length 1207 and the fourth length 1208 are substantially the same. However, in this illustrative embodiment the first length 1205 and the second length 1206 are different when compared to synthetic strands in the third bundle 1203 and the fourth bundle 1204.

In one or more embodiments, the length of at least two bundles of synthetic strands is different from the length of at least two other bundles. In this illustrative embodiment, the first length 1205 of the first bundle 1201, and the second length 1206 of the second bundle 1202 of synthetic hair strands are shorter than the third length 1207 of the third bundle 1203 of synthetic hair strands and the fourth length 1208 of the fourth bundle 1204. Said differently, the common length defined by the first length 1205 and the second length 1206 is shorter than the common length defined by the third length 1207 and the fourth length 1208.

The first length 1205, the second length 1206, the third length 1207, and the fourth length 1208 can be any of a number of lengths. In one embodiment, where the resulting braiding hair assembly formed by the bundles is desired to have a maximum length of thirty inches, the first length 1205 and the second length 1206 are seventeen inches. In one embodiment, where the resulting braiding hair assembly formed by the bundles is desired to have a maximum length of thirty inches, the third length 1207 and the fourth length 1208 are one of twenty-five inches or twenty-six inches.

In one embodiment, where the resulting braiding hair assembly formed by the bundles is desired to have a maximum length of forty inches, the first length 1205 and the second length 1206 are twenty-six inches. In one embodiment, where the resulting braiding hair assembly formed by the bundles is desired to have a maximum length of forty inches, the third length 1207 and the fourth length 1208 are thirty-five inches.

In one embodiment, where the resulting braiding hair assembly formed by the bundles is desired to have a maximum length of fifty inches, the first length 1205 and the second length 1206 are thirty-four inches. In one embodiment, where the resulting braiding hair assembly formed by the bundles is desired to have a maximum length of fifty inches, the third length 1207 and the fourth length 1208 are forty-three inches.

In one embodiment, where the resulting braiding hair assembly formed by the bundles is desired to have a maximum length of sixty inches, the first length 1205 and the second length 1206 are forty-three inches. In one embodiment, where the resulting braiding hair assembly formed by the bundles is desired to have a maximum length of forty inches, the third length 1207 and the fourth length 1208 are fifty-two inches.

In one or more embodiments, therefore, the common length defined by the first length 1205 and the second length 1206 is between eight inches and ten inches shorter than the common length defined by the third length 1207 and the fourth length 1208. For example, in one embodiment the common length defined by the first length 1205 and the second length 1206 is nine inches shorter than the common length defined by the third length 1207 and the fourth length 1208. This difference between the common length defined by the first length 1205 and the second length 1206 and the common length defined by the third length 1207 and the fourth length 1208 is illustrative only, as other differences that are greater than ten inches, or shorter than eight inches, inches will be obvious to those of ordinary skill in the art having the benefit of this disclosure.

Figure 13:
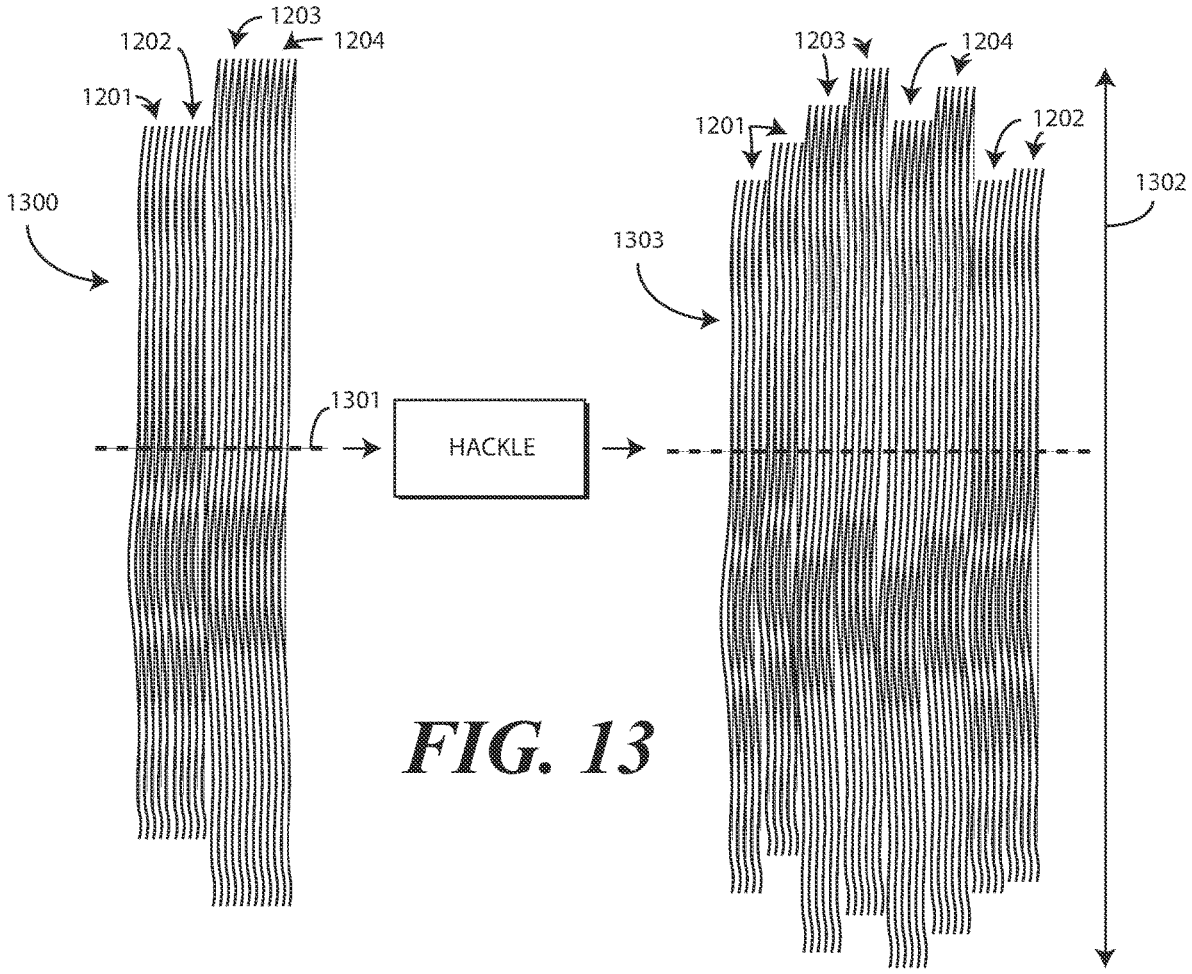
FIG. 13 illustrates braiding hair having different lengths being bundled in accordance with one or more embodiments of the disclosure.

Turning now to FIG. 13, the first bundle 1201 of synthetic hair strands, the second bundle 1202 of synthetic hair strands, the third bundle 1203 of synthetic hair strands, and the fourth bundle 1204 of synthetic hair strands are assembled together with a common central axis 1301 to form a braiding hair assembly 1300. The braiding hair assembly 1300 is then hackled, thereby distributing strands from the first bundle 1201 of synthetic hair strands, the second bundle 1202 of synthetic hair strands, the third bundle 1203 of synthetic hair strands, and the fourth bundle 1204 of synthetic hair strands evenly, in two dimensions (length and width) across the braiding hair assembly 1300. This results in a bundled synthetic braiding hair accessory 1303 being formed.

In one or more embodiments, the length 1302 of the bundled synthetic braiding hair accessory 1303 is longer than any of the first length (1205), the second length (1206), the third length (1207), or the fourth length (1208). For example, in one embodiment where the first length (1205) and the second length (1206) are seventeen inches, and the third length (1207) and the fourth length (1208) are twenty-six inches, the length 1302 of the bundled synthetic braiding hair accessory 1303 is thirty inches after hackling. In another embodiment where the first length (1205) and the second length (1206) are twenty-six inches, and the third length (1207) and the fourth length (1208) are thirty-five inches, the length 1302 of the bundled synthetic braiding hair accessory 1303 is forty inches after hackling.

In another embodiment where the first length (1205) and the second length (1206) are thirty-four inches, and the third length (1207) and the fourth length (1208) are forty-three inches, the length 1302 of the bundled synthetic braiding hair accessory 1303 is fifty inches after hackling. In another embodiment where the first length (1205) and the second length (1206) are forty-three inches, and the third length (1207) and the fourth length (1208) are fifty-two inches, the length 1302 of the bundled synthetic braiding hair accessory 1303 is sixty inches after hackling. As noted, other dimensions for the bundles and resulting lengths of the bundled synthetic braiding hair accessory 1303 will be obvious to those of ordinary skill in the art having the benefit of this disclosure. Additionally, the amount of hackling occurring can vary the length 1302 of the bundled synthetic braiding hair accessory 1303. Once the bundled synthetic braiding hair accessory 1303 is formed, it can be folded and packaged as described above with reference to FIGS. 3-4 and 9-10.

Figure 14:
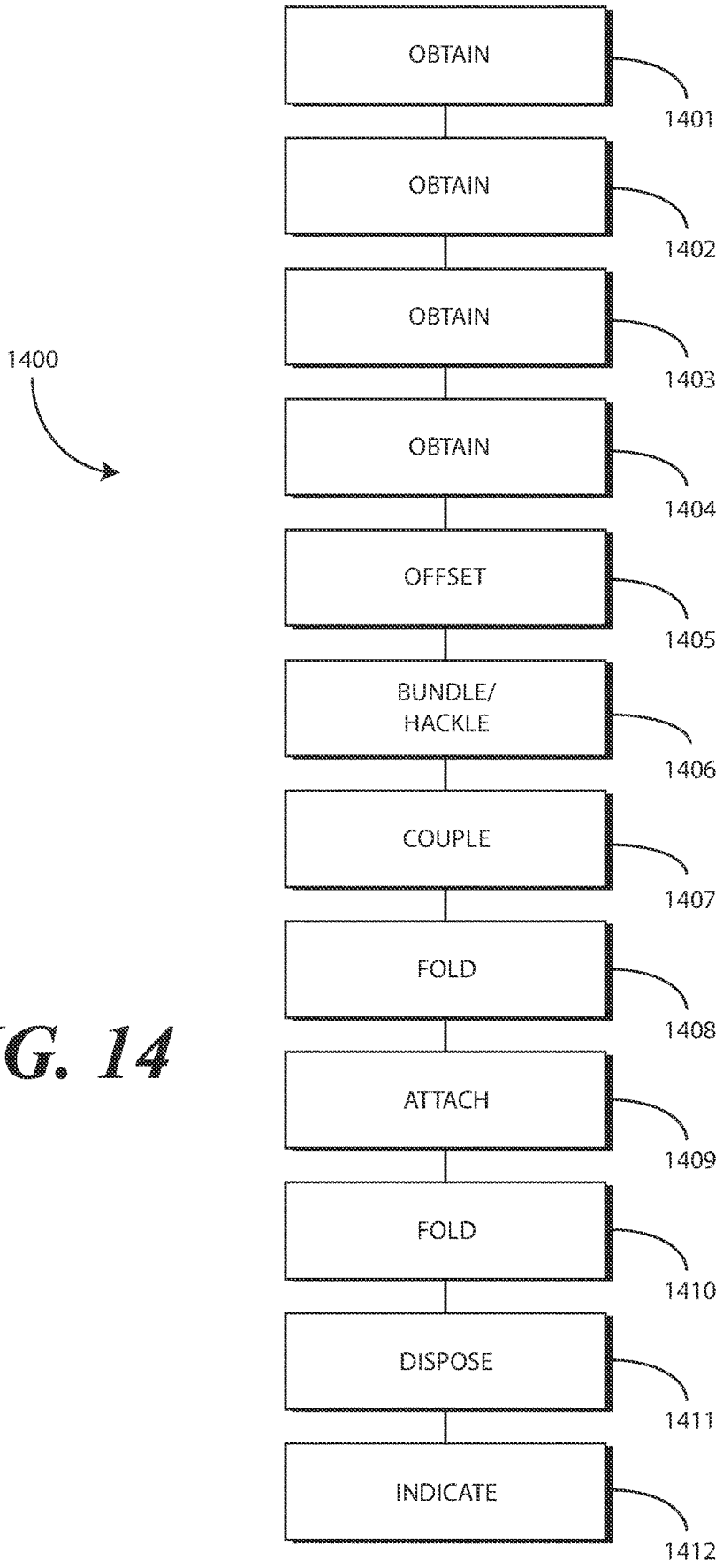
FIG. 14 illustrates another explanatory method in accordance with one or more embodiments of the disclosure.

Turning now to FIG. 14, illustrated therein is another explanatory method 1400 in accordance with one or more embodiments of the disclosure. Beginning at step 1401, the method 1400 includes obtaining a first bundle of synthetic hair stands having a predefined length. At step 1402, the method 1400 includes obtaining a second bundle of synthetic hair strands having the predefined length.

At optional step 1403, the method 1400 includes obtaining a third bundle of synthetic hair strands having the predefined length. At optional step 1404, the method 1400 includes obtaining a fourth bundle of synthetic hair strands having the predefined length. Additional bundles beyond the fourth bundle can optionally be obtained as well.

At step 1405, the method 1400 includes offsetting the centers of the first bundle of synthetic hair strands and the second bundle of synthetic hair strands. Where they are included, step 1405 can also include offsetting the centers of the third bundle of hair strands and the fourth bundle of hair strands. Illustrating by example, in one or more embodiments the center of the first bundle of hair strands is offset by from the center of the second bundle of hair strands by a first predefined distance at step 1405. Where included, the center of the third bundle of hair strands can be offset from the center of the second bundle of hair strands by a second predefined distance, while the center of the fourth bundle of hair strands is offset from the center of the third bundle of hair strands by another predefined distance, and so forth. The predefined distance between each center can be the same or different.

At step 1406, the method 1100 includes bundling at least the first bundle of synthetic hair strands and the second bundle of synthetic hair strands to form bundled synthetic braiding hair. Where more bundles are included, step 1406 can include assembling the first bundle of synthetic hair strands, the second bundle of synthetic hair strands, the third bundle of synthetic hair strands, and the fourth bundle of synthetic hair strands together with their centers offset relative to each other center by a predefined distance to form a braiding hair assembly.

In one or more embodiments, step 1406 further comprises hackling the first bundle and the second bundle as noted above. Where step 1403 is included, the bundling of step 1406 comprises bundling the third bundle with the first bundle and the second bundle. Where step 1404 is included, the bundling of step 1406 comprises bundling the fourth bundle with the first bundle and the second bundle and the third bundle. Where additional bundles are included, they can be bundled with the others at step 1406 as well. Where step 1403 includes bundling one or more of the third bundle and the fourth bundle, step 1406 can include hackling these bundles as well.

Accordingly, in one or more embodiments step 1406 comprises hackling the braiding hair assembly. In one or more embodiments, this evenly distributes the various hair strands throughout the braiding hair assembly. In one or more embodiments, the hackling causes the various strands of hair from the first bundle of synthetic hair strands, the second bundle of synthetic hair strands, and (where included) the third bundle of synthetic hair strands, and the fourth bundle to separate and unevenly overlap as shown above in FIG. 7.

At step 1407, the method 1400 optionally comprises coupling a binder about a waist of the bundled synthetic braiding hair. At step 1408, the method 1400 includes folding the bundled synthetic braiding hair about the binder to define a substantially cardioid shaped perimeter.

At optional step 1409, the method 1400 optionally includes attaching the binder to a backer panel. At optional step 1410, the method 1400 optionally includes folding the backer panel about the binder so that a first portion of the backer panel completely spans a first side of the bundled synthetic braiding hair and a second portion of the backer panel partially spans a second side of the bundled synthetic braiding hair.

At optional step 1411, the method 1400 includes disposing the braiding hair assembly in a package, optionally with the backer panel. In one embodiment, this disposition is such that a second side of the substantially cardioid shaped perimeter disposed opposite a cusp side of the substantially cardioid shaped perimeter is exposed beneath the second portion of the backer panel. At optional step 1412, the method 1400 can include indicating the first length on the second portion of the backer panel.

Figure 15:
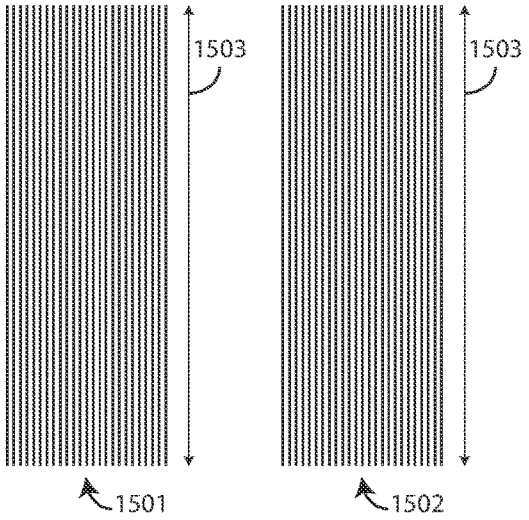
FIG. 15 illustrates braiding hair having common lengths in accordance with one or more embodiments of the disclosure.

Turning now to FIG. 15, illustrated therein are two bundles of synthetic braiding hair. Each bundle comprises a plurality of synthetic hair strands. As shown, there is a first bundle 1501 of synthetic braiding hair strands and a second bundle 1502 of synthetic braiding hair strands. As previously described, additional bundles can be added to the first bundle 1501 of synthetic braiding hair strands and the second bundle 1502 of synthetic braiding hair strands as described above with reference to FIG. 6. For example, a third bundle of synthetic braiding hair strands, and a fourth bundle of synthetic braiding hair strands can be added to the first bundle 1501 of synthetic braiding hair strands and the second bundle 1502 of synthetic braiding hair strands. Accordingly, while two bundles of synthetic braiding hair are shown in this illustrative embodiment, bundled synthetic braiding hair assemblies configured in accordance with embodiments of the disclosure can have more than two bundles as well. Other combinations will be obvious to those of ordinary skill in the art having the benefit if this disclosure.

In this illustrative embodiment, the synthetic strands in each bundle have a corresponding length. In this illustrative embodiment, the synthetic strands in each bundle have a common length 1503. For example, the first bundle 1501 of synthetic hair strands has the common length 1503, as does the second bundle 1202 of synthetic hair strands. Where included, any third bundle of synthetic hair strands, fourth bundle of synthetic hair strands, or other bundle of synthetic hair strands may have the common length 1503 as well. In one or more embodiments, each synthetic strand in each bundle has a common length, and this common length is the same as all the lengths of synthetic strands in the other bundles.

As noted above, the common length 1503 can be any of a number of lengths. In one embodiment, where the resulting braiding hair assembly formed by the bundles is desired to have a maximum length of thirty inches, common length 1503 is thirty inches. Where the resulting braiding hair assembly formed by the bundles is desired to have a maximum length of forty inches, the common length 1503 is forty inches. Where the resulting braiding hair assembly formed by the bundles is desired to have a maximum length of fifty inches, the common length 1503 can be fifty inches. Where the resulting braiding hair assembly formed by the bundles is desired to have a maximum length of sixty inches, the common length 1503 can be sixty inches.

Figure 16:
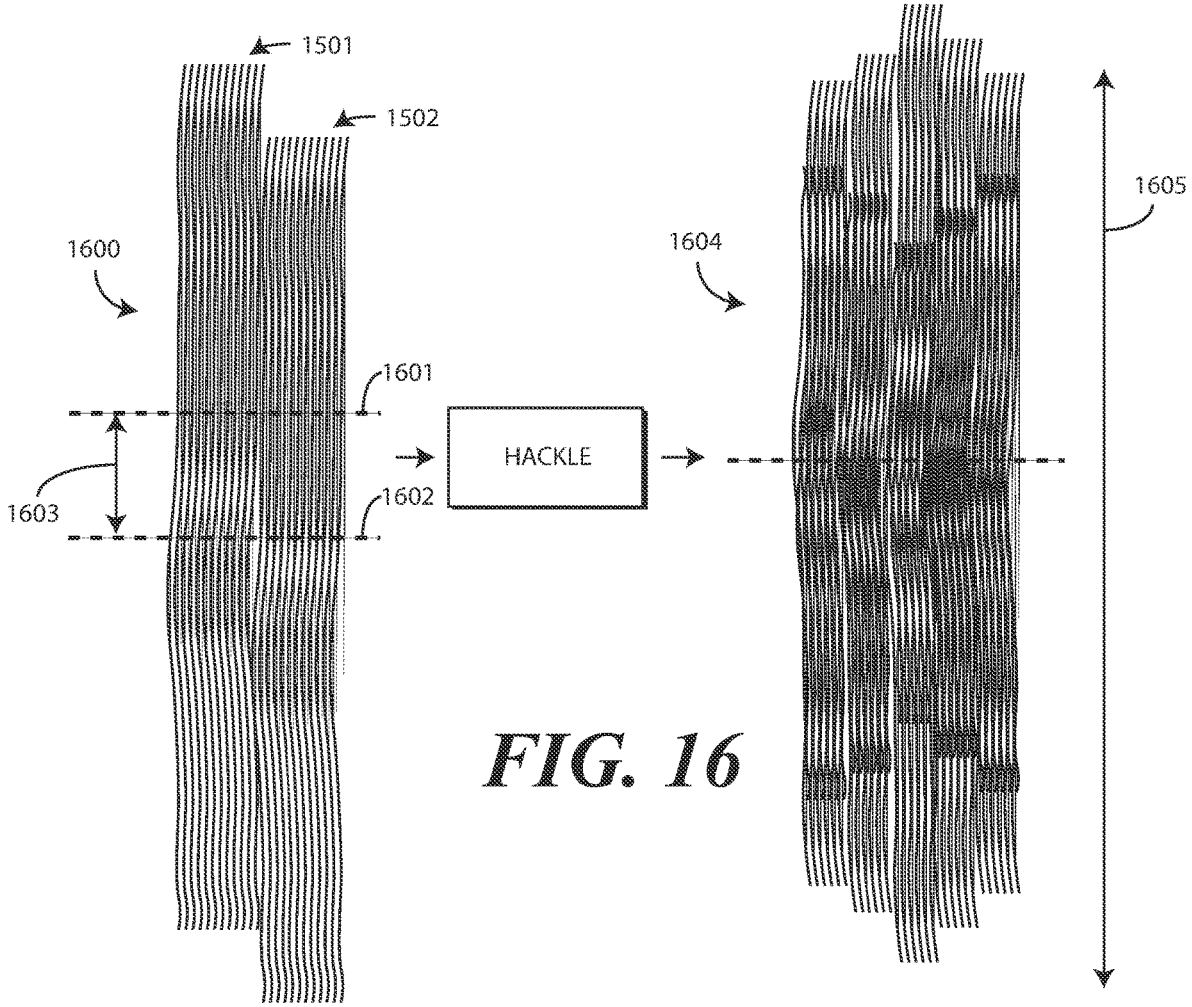
FIG. 16 illustrates braiding hair having common lengths being bundled in accordance with one or more embodiments of the disclosure.

Turning now to FIG. 16, the first bundle 1501 of synthetic hair strands and the second bundle 1502 of synthetic hair strands are assembled together with their centers 1601,1602 offset by a predefined distance 1603 to form a braiding hair assembly 1600. Where included, the third bundle of synthetic hair strands and the fourth bundle of synthetic hair strands can be included with their centers offset as well. In one or more embodiments, each center of each bundle of synthetic hair strands is offset from each center of each other bundle of synthetic hair strands by a predefined distance. The distances between each center of each bundle of synthetic hair strands can be the same or different.

In one or more embodiments, the braiding hair assembly 1600 is then hackled, thereby asymmetrically distributing strands from the first bundle 1501 of synthetic hair strands and the second bundle 1502 of synthetic hair strands in two dimensions (length and width) across the braiding hair assembly 1600. This results in a bundled synthetic braiding hair accessory 1604 being formed.

In one or more embodiments, the length 1605 of the bundled synthetic braiding accessory 1604 is longer than the common length (1503). For example, in one embodiment where the common length (1503) seventeen inches, the length 1605 of the bundled synthetic braiding hair accessory 1604 is thirty inches after hackling. In another embodiment, where the common length (1503) is twenty-six inches, the length 1605 of the bundled synthetic braiding hair accessory 1604 is forty inches after hackling.

In another embodiment where the common length (1503) is thirty-four inches, the length 1605 of the bundled synthetic braiding hair accessory 1604 is fifty inches after hackling. In another embodiment, where the common length (1503) forty-three inches, the length 1605 of the bundled synthetic braiding hair accessory 1604 is sixty inches after hackling. As noted, other dimensions for the common length (1503) and resulting lengths of the bundled synthetic braiding hair accessory 1604 will be obvious to those of ordinary skill in the art having the benefit of this disclosure. Additionally, the amount of hackling occurring can vary the length 1605 of the bundled synthetic braiding hair accessory 1604. Once the bundled synthetic braiding hair accessory 1604 is formed, it can be folded and packaged as described above with reference to FIGS. 3-4 and 9-10.

Figure 17:
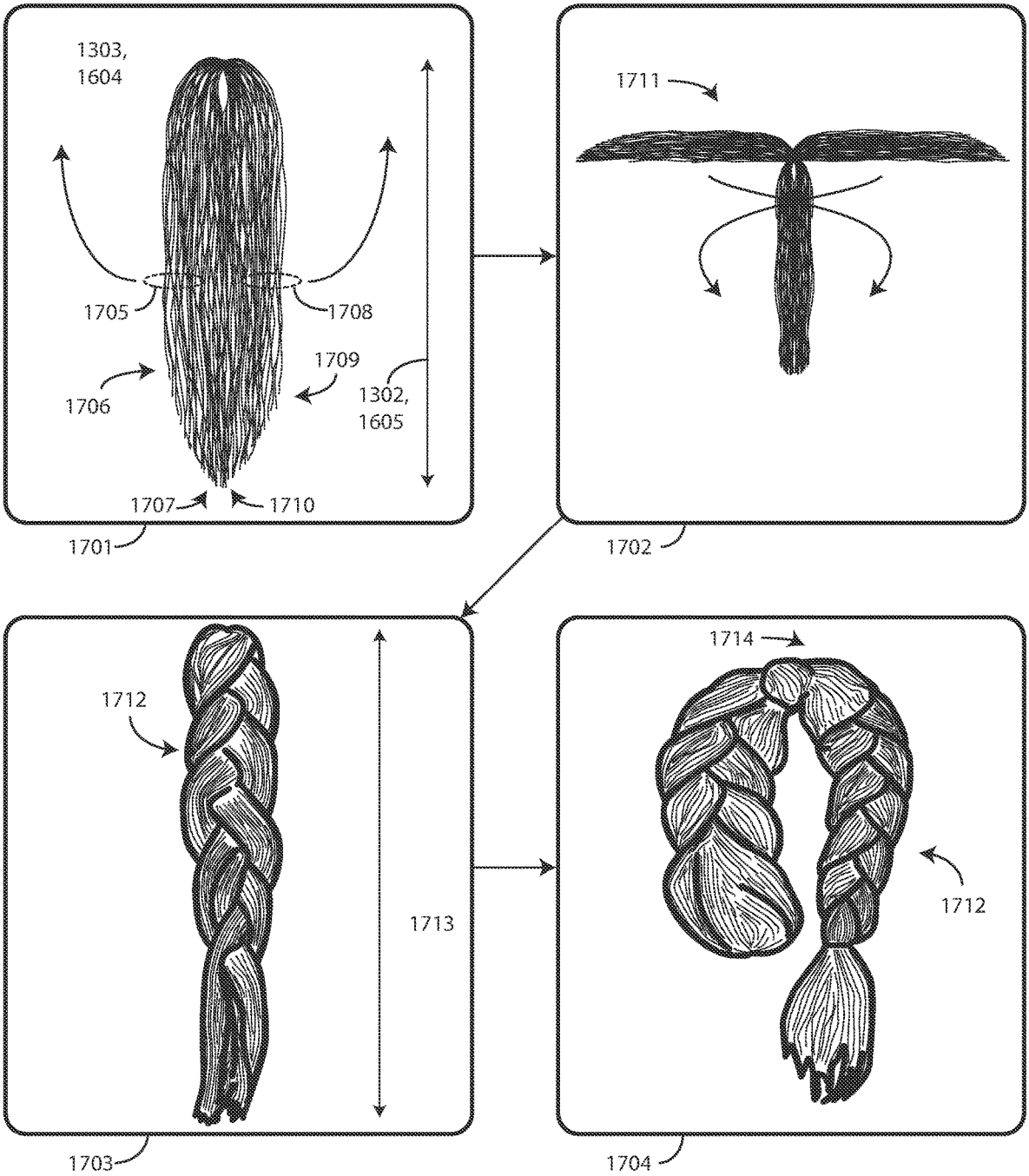
FIG. 17 Illustrates one or more method steps in accordance with one or more embodiments of the disclosure.

Turning now to FIG. 17, illustrated therein are one or more method steps for shortening a length 1302,1605 of a bundled synthetic braiding hair accessory 1303,1604 in accordance with one or more embodiments of the disclosure. Embodiments of the disclosure contemplate that the length 1302,1605 of the bundled synthetic braiding hair accessory 1303,1604 may be too long for the packaging used in the packaging steps described above. To conveniently situate the bundled synthetic braiding hair accessory 1303,1604 in a package, in one or more embodiments braiding is used to shorten the length 1302,1605 of the bundled synthetic braiding hair accessory 1303,1604.

Recall from above that in one or more embodiments the bundled synthetic braiding hair accessory 1303,1604 is folded to arrange the bundled synthetic braiding hair accessory 1303,1604 so as to have a perimeter that narrows as the bundles of synthetic braiding hair extend from a first end of the perimeter to a second end of the perimeter. At step 1701 a first portion 1705 of one folded side 1706 of the bundled synthetic braiding hair accessory 1303,1604 is separated from a second portion 1707 of that folded side 1706 of the bundled synthetic braiding hair accessory 1303,1604. Similarly, a first portion 1708 of another folded side 1709 of the bundled synthetic braiding hair accessory 1303,1604 is separated from a second portion 1710 of that folded side 1709 of the bundled synthetic braiding hair accessory 1303, 1604. The resulting separated bundled synthetic braiding hair accessory 1711 is shown at step 1702.

The three portions of the separated bundled synthetic braiding hair accessory 1711 can then be braided to define a braid 1712, one example of which is shown at step 1703. Since these three portions are braided, the length 1713 of the braid 1712 is shorter than the length 1302,1605 of the bundled synthetic braiding hair accessory 1303,1604, which makes the braid 1712 easier to situate within a package.

At the same time, embodiments of the disclosure contemplate that the length 1713 of the braid 1712 may still be too long for a particular package. Accordingly, to accommodate for such situations, additional post-processing steps can be taken to further reduce the overall length of the construct. One example of this is shown at step 1704, where the braid 1712 is bent. In this illustrative embodiment, the braid 1712 is bent by folding the braid 1712 about a midsection 1714 of the braid 1712, which results in a folded braid. The length of this overall construct is shorter than that of step 1703, where the braid 1712 is left in a linear configuration.

Figure 18:
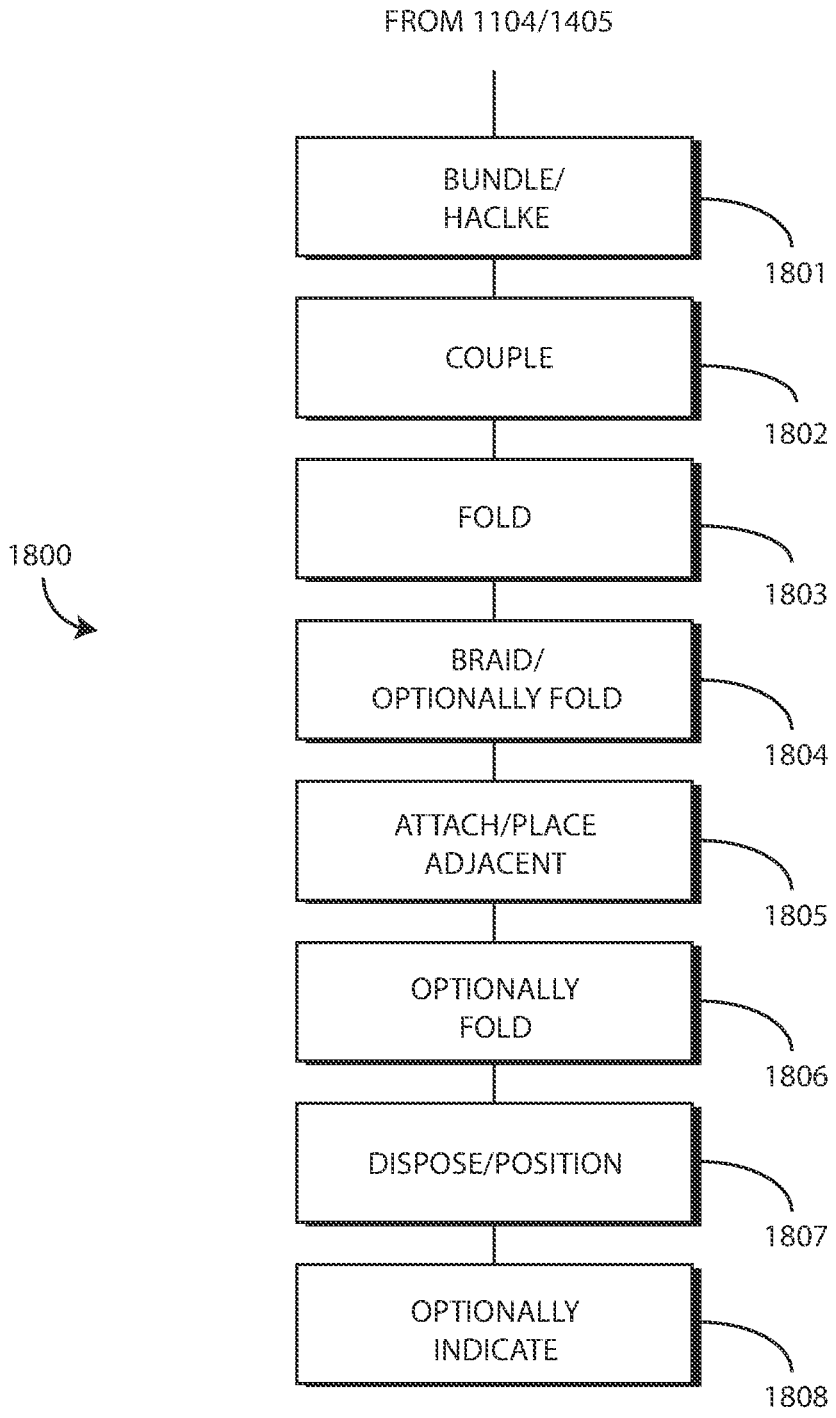
FIG. 18 illustrates another explanatory method in accordance with one or more embodiments of the disclosure.

Turning now to FIG. 18, illustrated therein is one explanatory method 1800 for packaging bundled synthetic braiding hair in accordance with one or more embodiments of the disclosure. In one or more embodiments, the method 1800 begins with the output of either step 1405 from FIG. 14 or the output of step 1104 from FIG. 11, each of provides at least a first bundle of synthetic hair strands with a second bundle of synthetic hair strands. In one or more embodiments, the first bundle of synthetic hair strands has a different length than the second bundle of synthetic hair strands. In other embodiments, the first bundle of synthetic hair strands has the same length as the second bundle of synthetic hair strands. As previously described, the bundles provided could include at least one other bundle of synthetic hair strands having either a different length with the other bundles or a common length with all the bundles.

At step 1801, the method 1800 includes bundling the first bundle and the second bundle (as well as additional bundles that may be included) to form bundled synthetic braiding hair. Where the bundles have different lengths, the bundling occurring at step 1801 includes bundling the bundles with a common waist. By contrast, where the bundles have a common length, the bundling occurring at step 1801 can include offsetting the waists of each bundle by a predefined distance as previously described.

In one or more embodiments, step 1801 further comprises hackling the first bundle and the second bundle. As described above, this hackling can include pulling the bundles of hair strands through a bed of metal or plastic spikes, which allows the friction between the strands of hair and the spikes to comb and effectively evenly distributing the various hair strands throughout the resulting bundled synthetic braiding hair. The hackling can also extend the length of the resulting bundled synthetic braiding hair as well, as previously described.

At step 1802, the method 1800 optionally comprises coupling a binder about a waist of the bundled synthetic braiding hair. At step 1803, regardless of whether a binder is coupled to the waist, in one or more embodiments the method 1800 includes folding the bundled synthetic braiding hair about the waist. In one or more embodiments, this arranges the bundled synthetic braiding hair to define a perimeter having a second end distally separated from a first end. A central portion or middle of the perimeter can separate the first end of the perimeter from the second end of the perimeter. In one or more embodiments, the width of the perimeter narrows as the bundled synthetic braiding hair extends distally to the second end. For instance, the width of the perimeter can narrow as the bundled synthetic braiding hair extends from the middle portion to the second end. In one or more embodiments, this causes the perimeter to define a substantially cardioid shaped perimeter. The perimeter can include a rounded second end. Alternatively, the second end can define a pointed nadir. As previously noted, the bundled synthetic braiding hair can comprise prestretched hair as well.

Where the length of the bundled synthetic braiding hair is then too long for a package, step 1804 can include braiding the bundled into a braid. In one or more embodiments, this braiding occurs after the bundled synthetic braiding hair is arranged to define the perimeter described above with reference to step 1802. Where the braid is still too long for a package, step 1804 can also include bending or folding the braid. Illustrating by example, step 1804 can comprise folding the braid about a midsection of the braid such that the resulting braid defines a horseshoe shape. This further reduces the overall length of the construct so that it may neatly, conveniently, and easily be placed into a smaller package.

At steps 1805-1808, the bundled synthetic braiding hair, be it in the perimeter that narrows as the bundled synthetic braiding hair extends distally to a second end of the perimeter, braided into a braid, or braided into a braid and folded, is packaged. In one or more embodiments, the bundled synthetic braiding hair is packaged with a backer panel at steps 1805-1808. Where, for example, a binder is coupled to the bundled synthetic braiding hair at step 1802, step 1805 can optionally include attaching the binder to a backer panel. Where the binder is not uses, step 1805 can include simply placing the bundled synthetic braiding hair adjacent to the backer panel within the package. Other techniques for combining the bundled synthetic braiding hair with a backer panel at step 1805 will be obvious to those of ordinary skill in the art having the benefit of this disclosure.

Where a backer panel is used, optional step 1806 can include folding the backer panel about the binder so that a first portion of the backer panel completely spans a first side of the bundled synthetic braiding hair and a second portion of the backer panel partially spans a second side of the bundled synthetic braiding hair.

Step 1807 then includes positioning the bundled synthetic braiding hair, be it in the perimeter that narrows as the bundled synthetic braiding hair extends distally to a second end of the perimeter, braided into a braid, or braided into a braid and folded, in the package. Where a backer panel is included, step 1807 can include positioning the backer panel in the package as well. In one embodiment, this disposition of the backer panel in the package is such that a second side of the bundled synthetic braiding hair, be it in the perimeter that narrows as the bundled synthetic braiding hair extends distally to a second end of the perimeter, braided into a braid, or braided into a braid and folded, is exposed from the backer panel. At optional step 1808, the method 1100 can include indicating a length of the bundles of hair strands on the package, the backer panel, or a medallion of the backer panel.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. For example, the synthetic braiding hair used with embodiments of the disclosure can be pre-stretched synthetic braiding hair or synthetic braiding hair that is not pre-stretched.

Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A hair accessory, comprising:

bundled synthetic braiding hair, comprising:

a first bundle of synthetic hair strands having a predefined length; and a second bundle of synthetic hair strands also having the predefined length;

wherein:

a center of the first bundle of synthetic hair strands and a center of the second bundle of synthetic hair strands are offset by a predefined distance;

the bundled synthetic braiding hair is hackled and arranged to define a perimeter having a first end, a middle, and a second end distally from the first end; and a width of the perimeter narrows as the bundled synthetic braiding hair extends distally from the middle of the perimeter to the second end;

wherein the bundled synthetic braiding hair is arranged as a braid;

wherein the braid is folded about a midsection of the braid.

2. The hair accessory of claim 1, wherein a length of the braid is shorter than another length of the bundled synthetic braiding hair.

3. The hair accessory of claim 1, wherein the braid is folded about midsection of the braid to define a folded braid having a shorter length than the braid when in a linear configuration.

4. The hair accessory of claim 1, wherein the braid is packaged with a backer panel.

5. The hair accessory of claim 1, wherein the second end is rounded.

6. The hair accessory of claim 1, wherein the second end defines a pointed nadir.

7. The hair accessory of claim 1, wherein the bundled synthetic braiding hair comprises pre-stretched hair.

8. The hair accessory of claim 1, the bundled synthetic braiding hair further comprising at least one other bundle of synthetic hair strands having the predefined length, wherein at least one other center of the at least one other bundle of synthetic hair strands is offset from both the center of the first bundle of synthetic hair strands and the center of the second bundle of synthetic hair strands.

9. The hair accessory of claim 1, wherein the bundled synthetic braiding hair is folded about a waist of the bundled synthetic braiding hair to define the perimeter.

10. The hair accessory of claim 9, further comprising a binder coupled about the waist of the bundled synthetic braiding hair.

11. The hair accessory of claim 1, further comprising a backer panel packaged with the bundled synthetic braiding hair.

12. A hair accessory, comprising:

bundled synthetic braiding hair, comprising:

a first bundle of synthetic hair strands having a predefined length; and a second bundle of synthetic hair strands also having the predefined length;

wherein:

a center of the first bundle of synthetic hair strands and a center of the second bundle of synthetic hair strands are offset by a predefined distance;

the bundled synthetic braiding hair is hackled and arranged to define a perimeter having a first end, a middle, and a second end distally from the first end; and a width of the perimeter narrows as the bundled synthetic braiding hair extends distally from the middle of the perimeter to the second end;

wherein the bundled synthetic braiding hair is folded about a waist of the bundled synthetic braiding hair to define the perimeter.

13. The hair accessory of claim 12, further comprising a binder coupled about the waist of the bundled synthetic braiding hair.

14. The hair accessory of claim 12, further comprising a backer panel packaged with the bundled synthetic braiding hair.

15. The hair accessory of claim 12, wherein the braid is packaged with a backer panel.

16. The hair accessory of claim 12, wherein the second end is rounded.

17. The hair accessory of claim 12, wherein the second end defines a pointed nadir.

18. The hair accessory of claim 12, wherein the bundled synthetic braiding hair comprises pre-stretched hair.

19. The hair accessory of claim 12, the bundled synthetic braiding hair further comprising at least one other bundle of synthetic hair strands having the predefined length, wherein at least one other center of the at least one other bundle of synthetic hair strands is offset from both the center of the first bundle of synthetic hair strands and the center of the second bundle of synthetic hair strands.

20. The hair accessory of claim 12, wherein a length of the braid is shorter than another length of the bundled synthetic braiding hair.

* * * * *